US008042907B2

(12) United States Patent
Sakaida

(10) Patent No.: US 8,042,907 B2
(45) Date of Patent: Oct. 25, 2011

(54) LIQUID EJECTION DEVICE

(75) Inventor: Atsuo Sakaida, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1047 days.

(21) Appl. No.: 11/862,571

(22) Filed: Sep. 27, 2007

(65) Prior Publication Data

US 2008/0079773 A1 Apr. 3, 2008

(30) Foreign Application Priority Data

Sep. 29, 2006 (JP) ..... 2006-266737

(51) Int. Cl.
*B41J 2/165* (2006.01)

(52) U.S. Cl. ..... 347/32; 347/33

(58) Field of Classification Search ..... 347/32
See application file for complete search history.

(56) References Cited

U.S. PATENT DOCUMENTS

| | | | | |
|---|---|---|---|---|
| 6,220,700 | B1 * | 4/2001 | Haigo | 347/85 |
| 2002/0044168 | A1 * | 4/2002 | Hashi et al. | 347/32 |
| 2005/0068365 | A1 * | 3/2005 | Takagi | 347/33 |
| 2005/0093939 | A1 | 5/2005 | Takagi | |
| 2006/0203032 | A1 | 9/2006 | Takagi | |
| 2006/0209120 | A1 | 9/2006 | Takagi | |

FOREIGN PATENT DOCUMENTS

| | | |
|---|---|---|
| JP | 2005132025 | 5/2005 |
| JP | 2006240192 | 9/2006 |

OTHER PUBLICATIONS

Notice of Reasons for Rejection (Office Action) dated Oct. 7, 2008 for corresponding Japanese Application No. 2006-266737—with an English translation of the part of the Notice where the cited document is related.

* cited by examiner

*Primary Examiner* — Charlie Peng
*Assistant Examiner* — Erin Chiem
(74) *Attorney, Agent, or Firm* — Banner & Witcoff, Ltd

(57) ABSTRACT

A liquid ejection device with a plurality of liquid ejection heads each having a liquid ejection surface that is elongated in a main scanning direction and is formed with a plurality of liquid ejection ports. Additionally, the device may have a maintenance unit, including a first maintenance tray, a second maintenance tray and a maintenance tray moving mechanism configured to move the first maintenance tray and the second maintenance tray in a predetermined direction. The device may also include a maintenance tray movement control portion configured to control the maintenance tray movement mechanism to move the first maintenance tray and the second maintenance tray wherein the first maintenance tray located at the first non-maintenance position and the second maintenance tray located at the second non-maintenance position at least partially overlap each other.

26 Claims, 12 Drawing Sheets

MAIN SCANNING DIRECTION

SUB SCANNING DIRECTION

LIQUID EJECTION DEVICE

CROSS REFERENCE TO RELATED APPLICATION

This application claims priority from Japanese Patent Application No. 2006-266737, filed on Sep. 29, 2006, the entire subject matter of which is incorporated herein by reference.

FIELD OF THE APPLICATION

The present application relates to a liquid ejection device including a plurality of liquid ejection heads each ejecting liquid therefrom.

BACKGROUND

Inkjet printers are known to include four inkjet heads aligned in a sheet conveying direction and a maintenance unit for performing maintenance on the inkjet heads. In such an inkjet printer, the maintenance unit includes a frame movable in a horizontal direction parallel to the sheet conveying direction, a blade disposed on the frame, a wiping roller, an ink sucking member, and four caps. The four caps are aligned parallel to each other in the sheet conveying direction to cover corresponding nozzle surfaces of the four inkjet heads. The maintenance of the four inkjet heads is performed as described below. When the maintenance unit is located at a purging position, the caps cover the respective nozzle surfaces and a purge operation is performed to eject ink from nozzles to the caps. After that, while the caps are separated from the respective nozzle surfaces and the maintenance unit is located at a retracted position, the ink sucking member, the wiping roller, and the blade face the nozzle surfaces in turn to suck or wipe the ink from the nozzle surfaces.

SUMMARY

In the above-described inkjet printer, the maintenance unit is sized to face all of the four inkjet heads both when located at the retracted position and at the purging position and its size is not variable. For example, in the inkjet printer, the four inkjet heads are referred to as one head group, and another four inkjet heads are additionally provided as another head group at a position that is shifted in a direction perpendicular to the sheet conveying direction such that a printable area of the one head group continues to a printable area of the another head group with respect to a direction perpendicular to the sheet conveying direction and is further shifted in the sheet conveying direction such that the one head group and the another head group do not overlap each other (e.g. at a position where the one head group and the another head group are provided so as to be diagonal to each other with respect to the sheet conveying direction). In this case, the maintenance unit needs to have a size corresponding to the eight inkjet heads of the two head groups. If the size of the maintenance unit is not variable so that it is a different size when located at the retracted position as opposed to when it is located at the purging position, then the inkjet printer is increased in size with respect to the sheet conveying direction.

Features described herein provide a liquid ejection device that can be reduced in size while having a plurality of liquid ejection heads.

Features described herein relate to a liquid ejection device with a plurality of liquid ejection heads each having a liquid ejection surface that is elongated in a main scanning direction and is formed with a plurality of liquid ejection ports. The plurality of liquid ejection surfaces defines a first liquid ejection area and a second liquid ejection area. Further, the device may have a recording medium conveyor mechanism configured to convey a recording medium in a sub scanning direction to pass the recording medium through an area facing the plurality of liquid ejection surfaces. Additionally, the device may have a maintenance unit, including a first maintenance tray, a second maintenance tray and a maintenance tray moving mechanism configured to move the first maintenance tray and the second maintenance tray in a predetermined direction. The maintenance tray moving mechanism is configured to move the first maintenance tray between a first maintenance position where the first maintenance tray faces the first liquid ejection area and a first non-maintenance position which is away from the first maintenance position in the predetermined direction. The maintenance tray moving mechanism is also configured to move the second maintenance tray between a second maintenance position where the second maintenance tray faces the second liquid ejection area and a second non-maintenance position which is away from the second maintenance position in the predetermined direction. The device may also include a maintenance tray movement control portion configured to control the maintenance tray movement mechanism to move the first maintenance tray and the second maintenance tray wherein the first maintenance tray located at the first non-maintenance position and the second maintenance tray located at the second non-maintenance position at least partially overlap each other.

Other objects, features, and advantages will be apparent to persons of ordinary skill in the art from the following detailed description and the accompanying drawings.

BRIEF DESCRIPTION OF THE DRAWINGS

Illustrative aspects will be described in detail with reference to the following figures in which like elements are labeled with like numbers and in which.

DETAILED DESCRIPTION

Illustrative embodiments will be described in detail with reference to the accompanying drawings.

Figure 1:
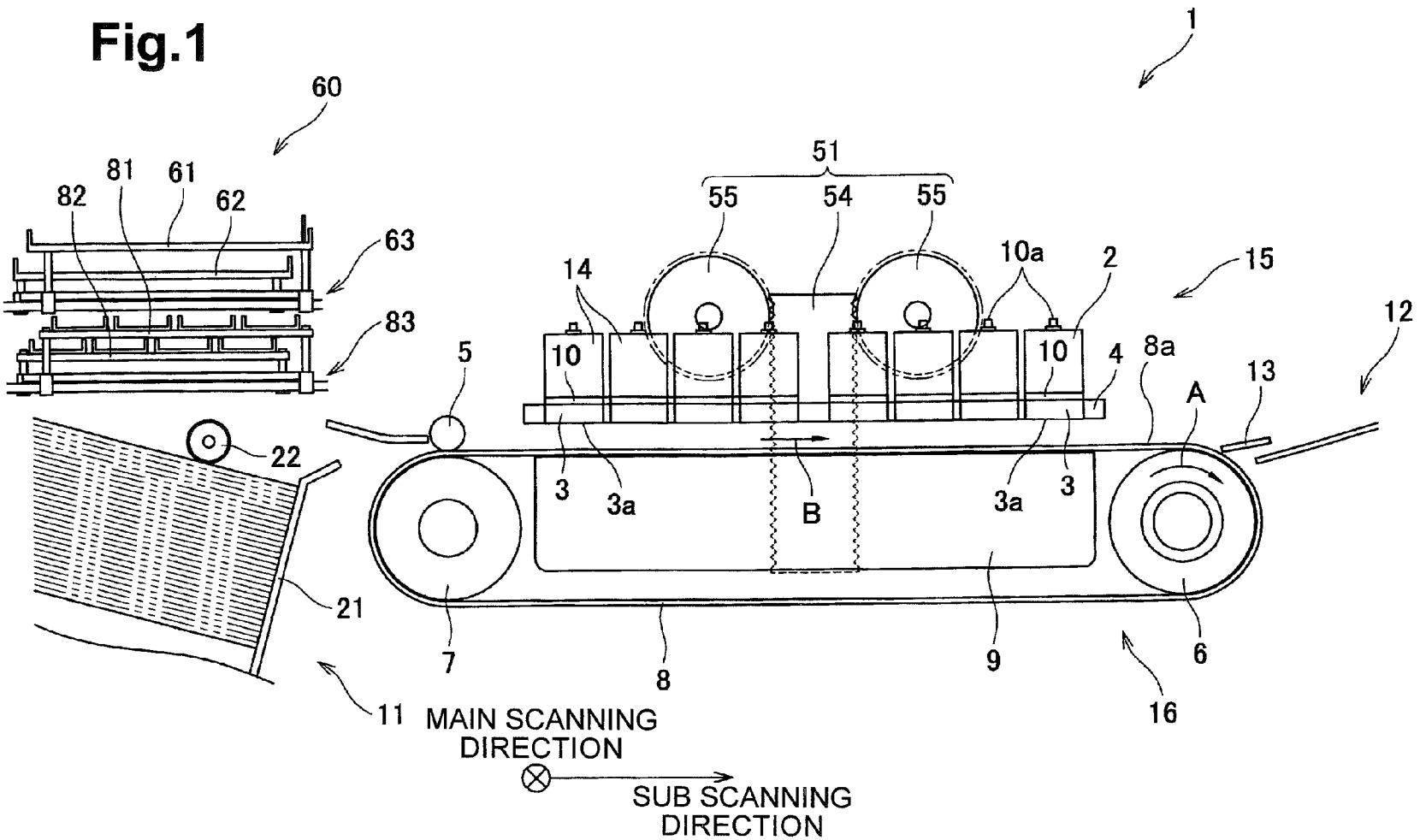
FIG. 1 is a side sectional view illustrating a general structure of an inkjet printer according to a first illustrative embodiment.

As shown in FIG. 1, an inkjet printer 1 (an example of a liquid ejection device) is a line-type color inkjet printer including a head unit 15 in which eight inkjet heads 2 (an example of liquid ejection heads) are fixed to a head frame 4. The inkjet printer 1 is provided with a sheet feed mechanism 11 and a sheet output portion 12 at a left part and a right part of the inkjet printer 1, respectively, in FIG. 1.

In the following description, the right side in FIG. 1 is referred to as the front side of the inkjet printer 1, while the left side in FIG. 1 is referred to as the rear side of the inkjet printer 1.

The inkjet printer 1 is provided in its inside with a sheet conveying path in which a recording medium, such as a sheet, is to be conveyed from the sheet feed mechanism 11 to the sheet output portion 12. The sheet feed mechanism 11 includes a pickup roller 22 that feeds, one by one, a topmost sheet of a plurality of sheets loaded in a sheet tray 21. As the pickup roller 22 is driven by a pickup motor 132 (see FIG. 7), a topmost sheet is conveyed from left to right in FIG. 1 in a sheet conveying direction B. In a middle part of the sheet conveying path, two belt rollers 6, 7 and an endless conveyor belt 8 are provided. The conveyor belt 8 runs between the belt rollers 6, 7. The belt roller 6 is provided with a drive force from a conveyor motor 133 (see FIG. 7) and is thus rotated in a clockwise direction in FIG. 1 (indicated by an arrow A). The belt rollers 6, 7 and the conveyor belt 8 constitute a conveyor unit 16 (an example of a recording medium conveyor mechanism) for conveying a sheet.

The conveyor belt 8 has a two-layer structure of a base material and its outer surface, urethane rubber. Therefore, a conveyor surface 8*a* has adhesion. A pressing roller 5 is disposed immediately downstream of the sheet feed mechanism 11 in the sheet conveying direction B at a position facing the conveyor belt 8. The pressing roller 5 presses a sheet fed from the sheet feed mechanism 11 against the conveyor surface 8*a* of the conveyor belt 8. By doing so, the sheet pressed against the conveyor surface 8*a* is conveyed in the sheet conveying direction B, while being held on the conveyor belt 8 by the adhesion of the conveyor surface 8*a*.

A separation member 13 is disposed along the sheet conveying path at a position immediately downstream of the conveyor belt 8 in the sheet conveying direction B. The separation member 13 is configured to separate the sheeton the conveyor belt 8 from the conveyor surface 8*a*, to further convey the sheet toward the sheet output portion 12.

A substantially box-shaped platen 9 is enclosed within the conveyor belt 8 so as to support the conveyor surface 8*a* of the conveyor belt 8 from below.

Figure 2:
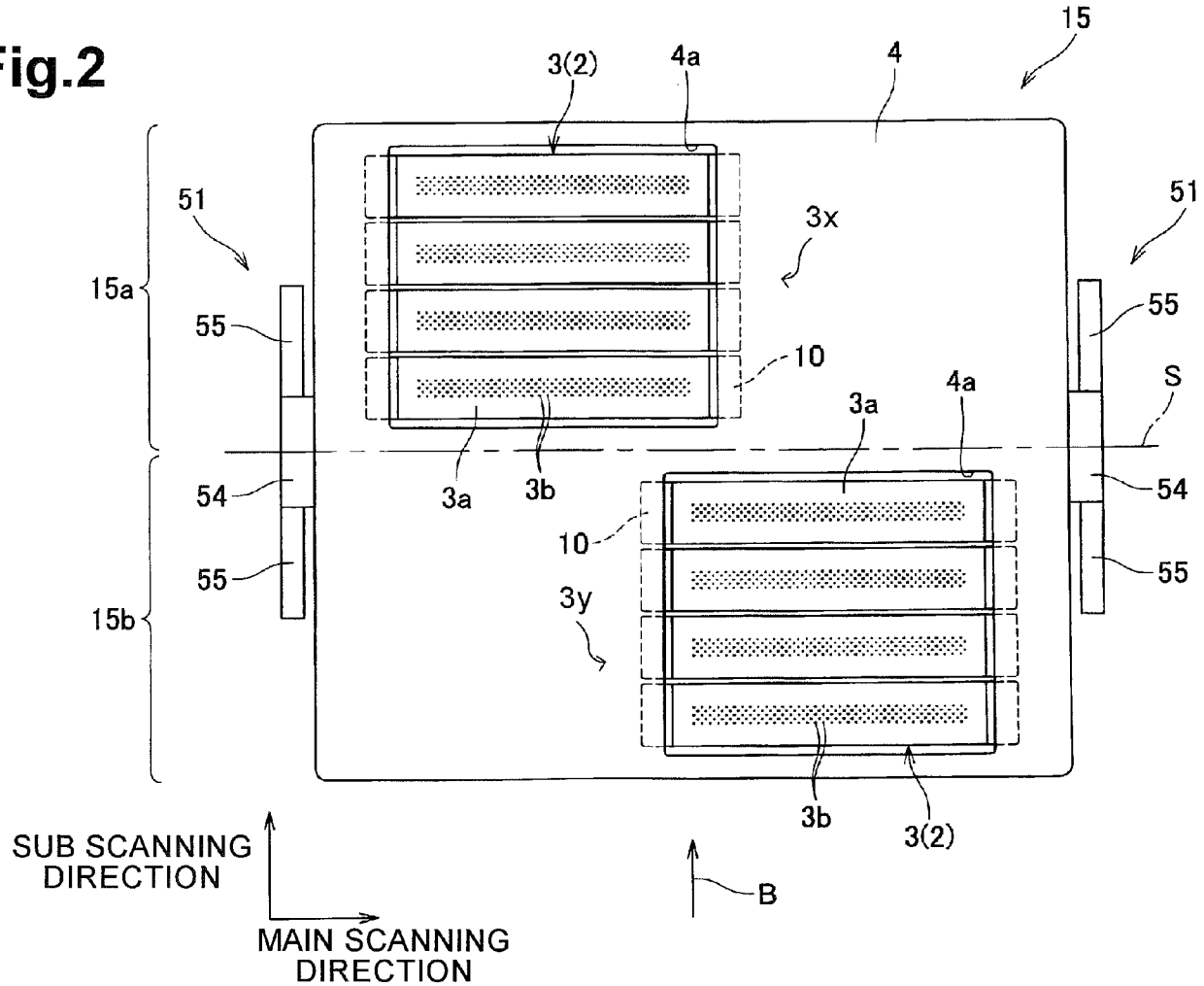
FIG. 2 is a plan view of a head unit of FIG. 1 when viewed from below.

As shown in FIGS. 1 and 2, each of the inkjet heads 2 has a box shape elongated in a main scanning direction (in a direction perpendicular to the sheet conveying direction B) and a head body 3 at its bottom. All of the inkjet heads 2 have the same structure and therefore only one of the inkjet heads 2 will be described.

The head body 3 is fixedly provided with a reservoir unit 10 at its upper surface to temporarily store ink therein. Ink stored in the reservoir unit 10 is supplied to an ink passage (not shown) of the head body 3. The reservoir unit 10 is partially covered with a cover 14. A tube joint 10*a*, fixed to a top of the cover 14, is connected with the reservoir unit 10 so that ink may be supplied through the tube joint 10*a* to the reservoir unit. As shown in FIG. 2, the head body 3 is formed with a plurality of nozzles 3*b* (an example of liquid ejection ports) having an extremely small diameter at its bottom. The bottom of the head body 3 constitutes an ink ejection surface 3*a* (an example of a liquid ejection surface) that faces the conveyor surface 8*a* of the conveyor belt 8. The reservoir unit 10 has an elongated body that is longer than a length of the head body 3 with respect to the main scanning direction. Further, the reservoir unit 10 has portions that are extended from both sides of the head body 3 in the main scanning direction. The extended portions of the reservoir unit 10 are used to fix the reservoir unit 10 to the head frame 4.

Figure 7:
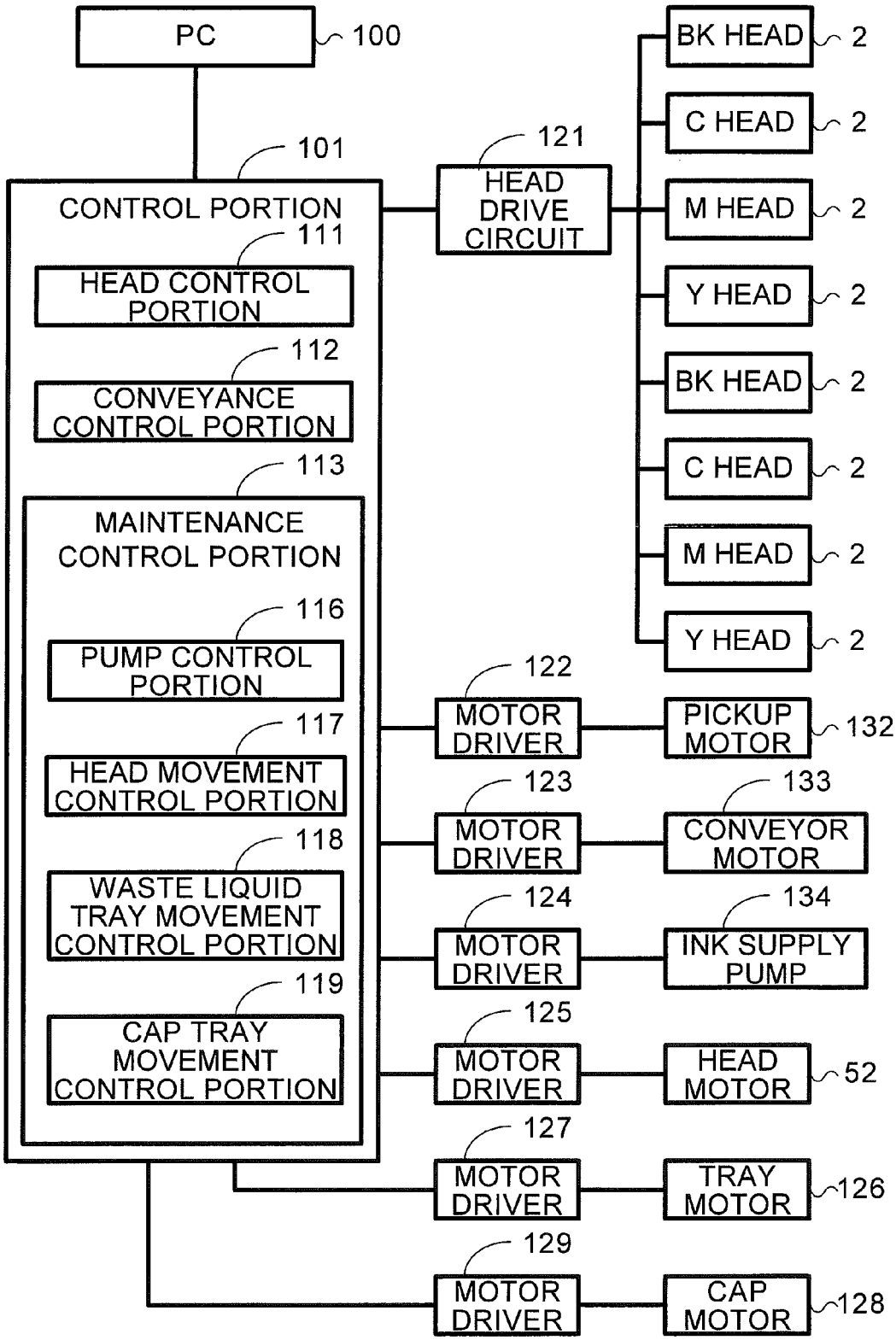
FIG. 7 is a block diagram showing an outline of a control system of the inkjet printer according to the first illustrative embodiment of the invention.

The tube joint 10*a* is connected with an ink tank (not shown) by a tube and an ink supply pump 134 (see FIG. 7). The ink can flow an inside of the ink supply pump 134, which constitutes a part of the ink passage. For example, when a purge operation is performed, the ink supply pump 134 is driven to forcefully supply the ink to the inkjet head 2. The purge operation can be an operation for resolving ejection failures of the nozzles 3*b* due to clogging of the nozzles or increase in viscosity of ink existing in the nozzles 3*b*. The purse operation restores the ink ejection properties of the inkjet heads 2. Further, the purge operation can be the initial ink introduction into the inkjet heads 2. Therefore, the initial ink introduction will be performed in a substantially similar manner to the purge operation for resolving the ink ejection properties.

As shown in FIG. 2, the eight inkjet heads 2 are divided into two head groups of four inkjet heads 2 each: a first head group 3*x* (an example of a first liquid ejection area) and a second head group 3*y* (an example of a second liquid ejection area). In each of the head groups 3*x*, 3*y*, the adjacent four ink ejection surfaces 3*a* are aligned in a sub scanning direction (in a direction parallel to the sheet conveying direction B) so as to be disposed close to each other without being displaced in the main scanning direction. The inkjet heads 2 belonging the respective head groups 3*x*, 3*y* are fixed to the head frame 4 while their ink ejection surfaces 3*a* are exposed via respective through portions 4*a* formed in the head frame 4. The first and second head groups 3*x*, 3*y* are offset from each other with respect to the sub scanning direction so as to be provided in a staggered arrangement. In this staggered arrangement, the ink ejection surfaces 3*a* in the first head group 3*x* and the ink ejection surfaces 3*a* in the second head group 3*y* overlap with each other in the sub scanning direction such that a printable area of the first head group 3*x* continues to a printable area of the second head group 3*y* in the sub scanning direction to constitute a single printable area in the head unit 15. That is, the head unit 15 has the printable area of a length of substantially two inkjet heads 2. With this structure, the head unit 15 has the printable area that is approximately twice as wide as a head unit having a printable area of a length of a single inkjet head 2.

The inkjet heads 2 in each of the head groups 3*x*, 3*y* correspond to four colors of ink, such as magenta, yellow, cyan, and black. These eight inkjet heads 2 and the head frame 4 constitute the head unit 15. In this embodiment, the bottom surface of the head frame 4 and the ink ejection surfaces 3*a* are aligned so as to be at the same level.

As shown in FIGS. 1 and 2, the head frame 4 is supported so as to be movable vertically by two frame moving mechanisms 51 (an example of a liquid ejection head moving mechanism). The frame moving mechanisms 51 are provided to the inkjet printer 1. The frame moving mechanisms 51 are disposed at respective ends of the head frame 4 in the main scanning direction. Each of the frame moving mechanisms 51 includes a rack gear 54 and two pinion gears 55. The rack gear 54 is extended in a vertical direction in FIG. 1 and is fixed to the head frame 4. The pinion gears 55 engage the rack gear 54 by sandwiching the rack gear 54. The pinion gears 55 are driven to rotate by a head motor 52 (see FIG. 7).

When the pinion gears 55 are rotated, the rack gear 54 moves upwards or downwards, depending on the direction of rotation of pinion gears. Further, the head unit 15 moves vertically, in accordance with the movements of the rack gear 54.

The head unit 15 is usually located at a printing position (see, e.g. the head unit 15 position in FIG. 1) where the ink ejection surfaces 3*a* and the conveyor surface 8*a* of the conveyor belt 8 extend in parallel to each other and a small clearance is provided between the ink ejection surfaces 3*a* and the conveyor surface 8*a* of the conveyor belt 8. The clearance constitutes a part of the sheet conveying path. With this structure, a sheet conveyed on the conveyor belt 8 passes under the eight head bodies 3 successively. Each color of ink is ejected from the nozzles 3*b* toward an upper surface, of the sheet to form a desired color image on the sheet. During maintenance of the inkjet heads 2, the head unit 15 is moved by the frame moving mechanisms 51 to a head standby position where the eight inkjet heads 2 are positioned at a higher level than they were during printing position.

Next, a maintenance unit 60 for performing maintenance on the inkjet heads 2 will be described. In FIGS. 3 to 6, waste liquid trays 61, 62 (an example of first and second maintenance trays) and cap trays 81, 82 (an example of first and second maintenance trays) have been withdrawn in the sub scanning direction.

As shown in FIG. 1, the inkjet printer 1 includes the maintenance unit 60 for performing the maintenance on the inkjet heads 2. The maintenance unit 60 is disposed above the sheet feed mechanism 11 and at the rear of the inkjet heads 2. The maintenance unit 60 includes the two waste liquid trays 61, 62, a waste liquid tray moving mechanism 63 (an example of a maintenance tray moving mechanism, the two cap trays 81, 82, and a cap tray moving mechanism 83 (an example of a maintenance tray moving mechanism. The waste liquid tray moving mechanism 63 is configured to move the waste liquid trays 61, 62 in the sub scanning direction. The cap tray moving mechanism 83 configured to move the cap trays 81, 82 in the sub scanning direction.

Figure 3:
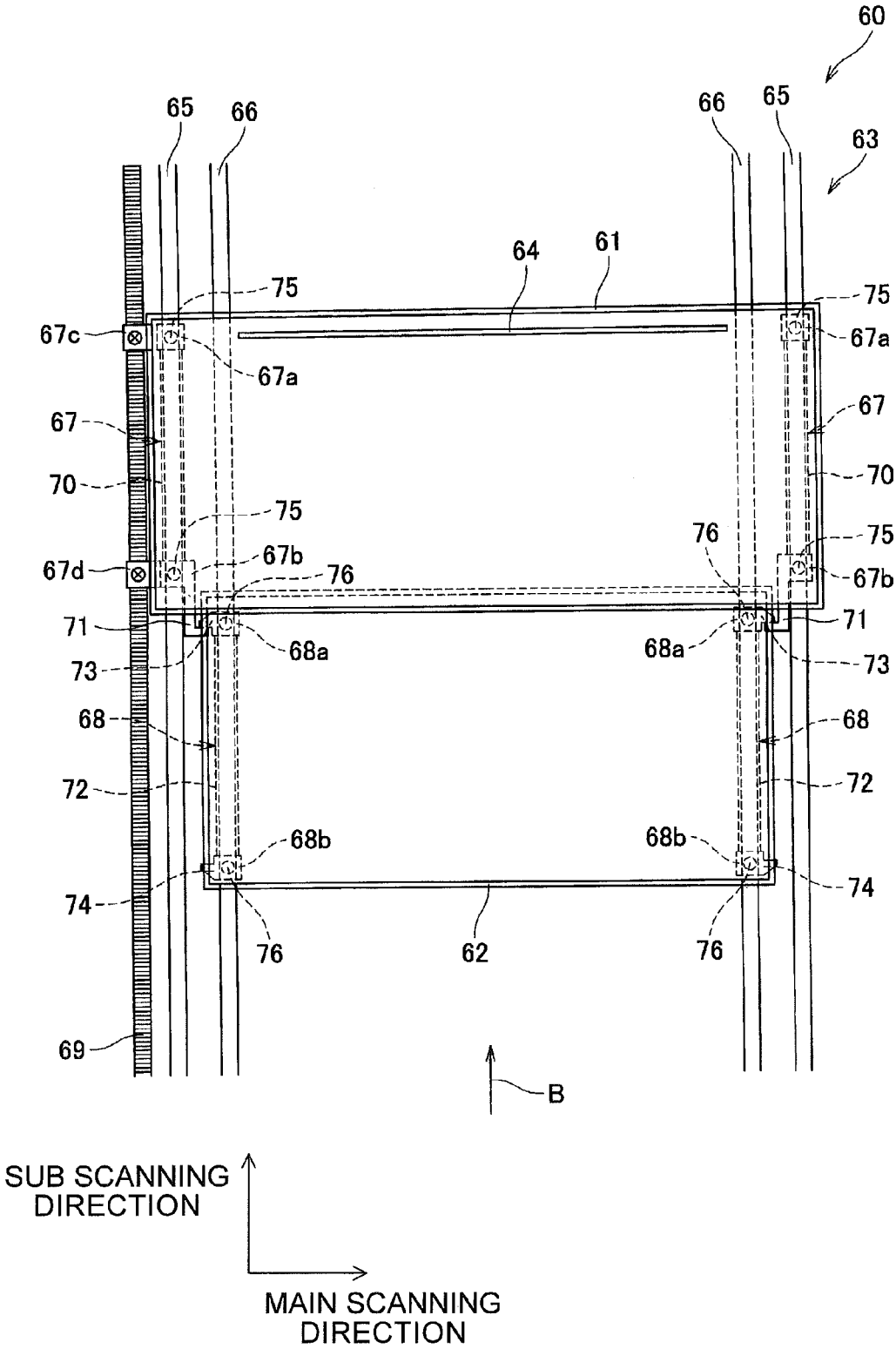
FIG. 3 is a plan view of a maintenance unit including two waste liquid trays and a waste liquid tray moving mechanism for moving the waste liquid trays.
Figure 4:
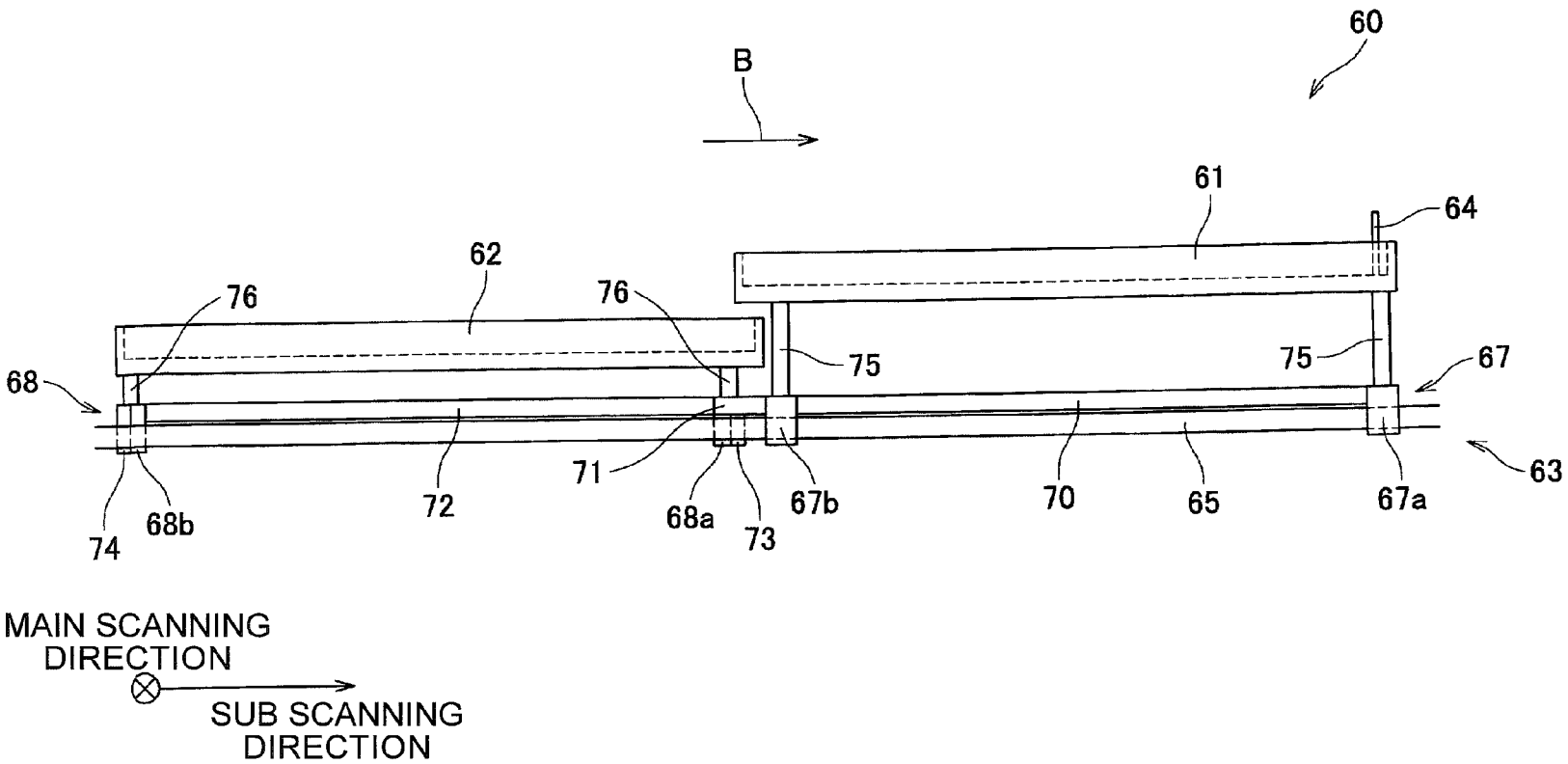
FIG. 4 is a side view of the waste liquid trays and the waste tray moving mechanism of FIG. 3.

Each of the waste liquid trays 61, 62 is substantially box shaped with an upper open structure, as shown in FIG. 3. The waste liquid tray 61 is located at a higher level than waste liquid tray 62. The waste liquid tray 61 is sized to face an entire area of a downstream half 15*a* of the head unit 15, and has a length greater than that of the waste liquid tray 62 in the main scanning direction. The waste liquid tray 62 is sized to face an entire area of an upstream half area 15*b* of the head unit 15, and has a width substantially the same as that of the waste liquid tray 61 in the sub scanning direction. In a plan view, a center line extending along the sub scanning direction in the head unit 15 is in common with a center line extending along the sub scanning direction in the waste liquid trays 61, 62.

The downstream half 15*a* and the upstream half 15*b* of the head unit 15 are defined by a center line S as a boundary, which extends in a direction parallel to the main scanning direction of the head unit 15. The four inkjet heads 2 belonging to the first head group 3*x* are provided in the downstream half 15*a*. The first head group 3*x* may be located at a position far from a waste liquid tray retracted position (described later) of the maintenance unit 60. The four inkjet heads 2 belonging to the second head group 3*y* are provided in the upstream half 15*b*. The second head group 3*y* may be located at a position closer to the waste liquid tray retracted position than the first head group 3*x*. The waste liquid tray 61 disposed at the higher position is configured to face the ink ejection surfaces 3*a* in the first head group 3*x*, and the waste liquid tray 62 disposed at the lower position is configured to face the ink ejection surfaces 3*a* in the second head group 3*y*.

As shown in FIG. 3, a wiper 64 is provided at a front end portion of the waste liquid tray 61. The wiper 64 is made of an elastic material elongated in the main scanning direction. The wiper 64 has a length that is longer than a total length in the main scanning direction of all of the inkjet heads 2 belonging to the first and second head groups 3*x*, 3*y*. The wiper 64 is disposed at a position where a center line of the wiper 64 extending along the sub scanning direction is aligned with the center line of the waste liquid tray 61 extending along the sub scanning direction. With this structure, the ink ejection surfaces 3*a* of the eight inkjet heads 2 can be wiped by the single wiper 64.

The waste liquid tray moving mechanism 63 includes a pair of first guide rails 65 (an example of a pair of first waste liquid tray guide rails), a pair of second guide rails 66 (an example of a pair of second waste liquid tray guide rails), a pair of first tray support members 67, a pair of second tray support members 68, and a timing belt 69 (an example of a first transmission mechanism). The first guide rails 65 extend in the sub scanning direction while the wiper 64 is interposed therebetween. The second guide rails 66 extend in the sub scanning direction and are disposed at an inwardly of the pair of first guide rails 65, but the wiper 64 is still interposed therebetween. The first tray support members 67 are slidably supported by the respective first guide rails 65 while supporting the waste liquid tray 61. The second tray support members 68 are slidably supported by the respective second guide rails 66 while supporting the waste liquid tray 62. The timing belt 69 is configured to move the first tray support members 67 in the sub scanning direction. As described above, the waste liquid tray moving mechanism 63 includes the two pairs of the guide rails 65, 66, and the two pairs of the tray support members 67, 68. Thus, the waste liquid trays 61, 62 can be easily moved in the sub scanning direction.

The first tray support members 67 are disposed between each of the first guide rails 65 and the waste liquid tray 61. Each of the first tray support member 67 has a front end portion 67*a*, a rear end portion 67*b*, and a connecting portion 70 that connects the front end portion 67*a* and the rear end portion 67*b* thereof. Each of the front end portions 67*a* and the rear end portions 67*b* is formed with a projection 75 that protrudes upward therefrom to support the bottom of the waste liquid tray 61.

Each of the rear end portions 67*b* of the first tray support members 67 is formed with an engaging hook 71 (an example of a second transmission mechanism or an engaging member). The engaging hooks 71 of the rear end portions 67*b* are configured to be engaged with the respective second tray support members 68. The front end portion 67*a* and the rear end portion 67*b* of one of the first tray support members 67 (the left first tray support member 67 in FIG. 3 in this embodiment) are formed with fixed portions 67*c*, 67*d*, respectively. The fixed portions 67*c*, 67*d* are fixed to the timing belt 69 by screws. The timing belt 69 is driven by a tray motor 126 (which may be a common motor) (see FIG. 7) to travel in a forward direction (in a direction that the waste liquid tray 61 is moved toward a position to face the ink ejection surfaces 3*a*) and in a backward direction (in a direction that the waste liquid tray 61 is moved toward the waste liquid tray retracted position).

The pair of second tray support members 68 are disposed between each of the second guide rails 66 and the waste liquid tray 62. Each of the second tray support members 68 has a front end portion 68*a*, a rear end portion 68*b*, and a connecting portion 72 that connects the front end portion 68*a* and the rear end portion 68*b*. Each of the front end portions 68*a* and the rear end portions 68*b* is provided with a protrusion 76 that protrudes upward to support the bottom of the waste liquid tray 62. The protrusions 76 of the second tray support members 68 are shorter in height than the protrusions 75 of the first tray support members 67. Therefore, the waste liquid trays 61, 62 are supported at the different levels.

Each of the front end portions 68*a* of the second tray support members 68 is formed with a projection 73 (an example of a second transmission mechanism or an engaged portion). The projections 71 of the front end portions 68*a* of the second tray support members 68 are configured to be engaged with the respective engaging hooks 71 of the rear end portions 67*b* of the first tray support members 67 when the waste liquid tray 61 is moved toward the front to allow the waste liquid trays 61, 62 to be arranged in a positional relationship where the waste liquid trays 61, 62 can face the downstream half 15*a* and the upstream half 15*b* of the head unit 15, respectively (e.g. the waste liquid trays 61, 62 are arranged in a positional relationship that is the same as that of the waste liquid trays 61, 62 located at an ink receiving position where the waste liquid trays 61, 62 receive ink purged from the eight inkjet heads 2). Each of the rear end portions 68*b* of the second tray support members 68 is formed with a projection 74 (an example of a second transmission mechanism or an engaged portion). The projections 74 of the rear end portions 68*b* of the second tray support members 68 are configured to engage the respective engaging hooks 71 of the rear end portions 67*b* of the first tray support members 67 when the waste liquid tray 61 is moved toward the rear. This allows the waste liquid trays 61, 62 to be arranged one above the other in an overlapped fashion when viewed from a direction perpendicular to the main scanning direction and the sub scanning direction (e.g. the waste liquid trays 61, 62 are collapsible, or arranged similar to the waste liquid tray retracted position shown in FIG. 1).

With this structure, as the timing belt 69 runs in the forward direction, the pair of first tray support members 67 and the waste liquid tray 61 move toward the right in FIG. 1 (toward the front), that is, from the waste liquid tray retracted position toward the ink receiving position. Before the waste liquid tray 61 reaches the ink receiving position, the engaging hooks 71 of the waste liquid tray 61 and the projections 73 of the waste liquid tray 62 engage with each other. Therefore, the pair of second tray support members 68 and the waste liquid tray 62 move toward the ink receiving position together with the waste liquid tray 61. As the timing belt 69 runs in the backward direction, the pair of first tray support members 67 and the waste liquid tray 61 move toward the left in FIG. 1 (toward the rear), that is, from the ink receiving position toward the waste liquid tray retracted position. Before the waste liquid tray 61 reaches the waste liquid tray retracted position, the engaging hooks 71 of the waste liquid tray 61 and the projections 74 of the waste liquid tray 62 engage with each other. Therefore, the pair of second tray support members 68 and the waste liquid tray 62 move toward the waste liquid tray retracted position together with the waste liquid tray 61.

Because the waste liquid tray moving mechanism 63 includes the above-described engaging hooks 71 and the projections 73, 74, the second tray support members 68 can be moved by moving just the first tray support members 67. Therefore, the waste liquid tray 62 can be moved by just moving the waste liquid tray 61. Accordingly, the movement and overlapping of the trays 61, 62 can be easily performed.

Figure 5:
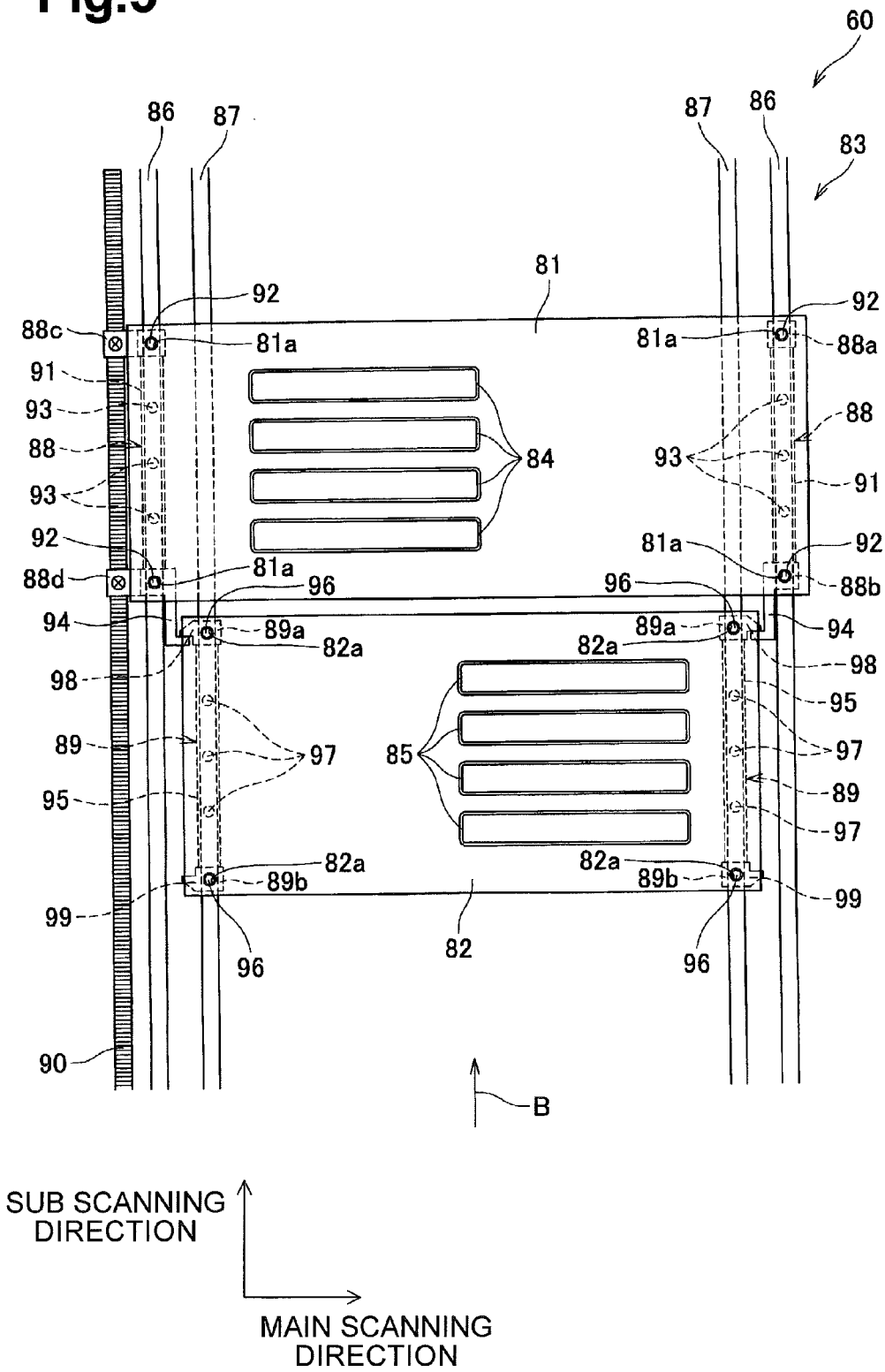
FIG. 5 is a plan view of the maintenance unit including two cap trays and a cap tray moving mechanism for moving the cap trays.
Figure 6:
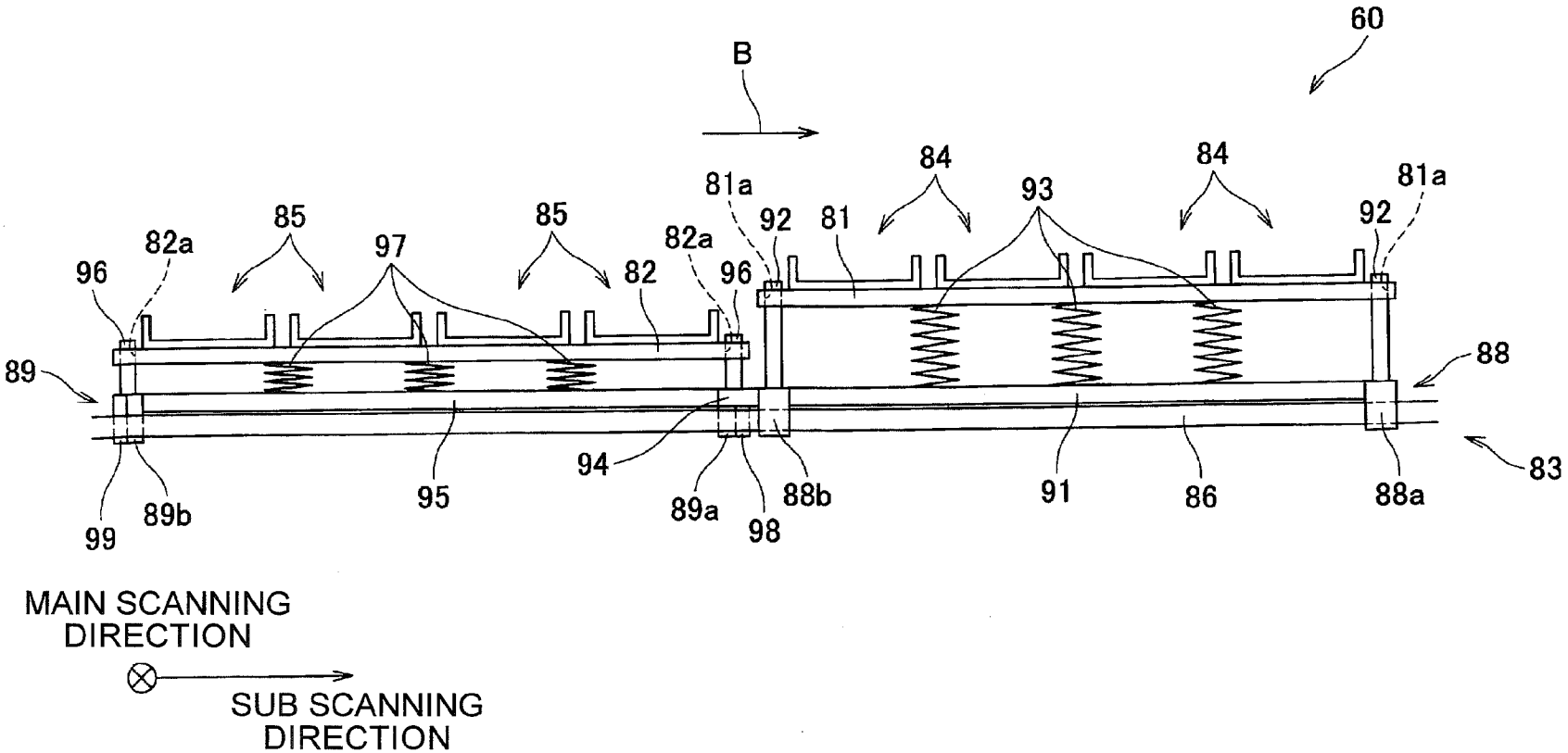
FIG. 6 is a side view of the cap trays and the cap tray moving mechanism of FIG. 5.

As shown in FIGS. 5 and 6, the cap trays 81, 82 are flat plates. The cap tray 81 includes four caps 84 (an example of first caps), which are configured to make contact with the corresponding ink ejection surfaces 3*a* of the four inkjet heads 2 provided in the downstream half 15*a* of the head unit 15 so as to provide enclosed spaces therebetween. The cap tray 82 includes four caps 85 (an example of second caps), which are configured to make contact with the corresponding ink ejection surfaces 3*a* of the four inkjet heads 2 provided in the upstream half 15*b* of the head unit 15 so as to provide enclosed spaces therebetween.

The cap tray 81 is located at a higher level than cap tray 82. Similar to the waste liquid tray 61, the cap tray 81 is sized to face substantially the entire area of the downstream half 15*a* of the head unit 15, and has a length greater than that of the cap tray 82 in the main scanning direction. Further, similar to the waste liquid tray 62, the cap tray 82 is sized to face substantially the entire area of the upstream half 15*b* of the head unit 15, and has a width substantially the same as that of the cap tray 81 in the sub scanning direction. In a plan view, a center line extending along the sub scanning direction in the head unit 15 is in common with a center line extending along the sub scanning direction in the cap trays 81, 82. As described above, the cap tray 81 disposed at the upper position may be configured to face the ink ejection surfaces 3*a* in the first head group 3*x* provided far from a cap tray retracted position (described later) and the cap tray 82 disposed at the lower position may be configured to face the ink ejection surfaces 3*a* in the second head group 3*y* provided near to the cap tray retracted position than the first head group 3*x*.

The cap tray moving mechanism 83 includes a pair of first guide rails 86 (an example of a pair of first cap guide rails), a pair of second guide rails 87 (an example of a pair of second cap guide rails), a pair of first tray support members 88 (an example of first cap tray support members), a pair of second support members 89 (an example of second cap tray support members), and a timing belt 90 (an example of a first transmission mechanism). The first guide rails 86 extend in the sub scanning direction while eight caps 84, 85 are interposed therebetween. The second guide rails 87 extend in the sub scanning direction and are disposed inwardly of the pair of first guide rails 86 while the caps 84, 85 are still interposed therebetween. The first tray support members 88 are slidably supported by the respective first guide rails 86 while supporting the cap tray 81 such that the cap tray 81 can be moved in the overlapping direction. The second tray support members 89 are slidably supported by the respective second guide rails 87 while supporting the cap tray 82 such that the cap tray 82 can be moved in the overlapping direction. The timing belt 69 is configured to move the first tray support members 88 in the sub scanning direction. As described above, the cap tray moving mechanism 83 includes the two pairs of the guide rails 86, 87, and the two pairs of the tray support members 88, 89. Thus, the cap trays 81, 82 can be easily moved in the sub scanning direction.

The first tray support members 88 are disposed between each of the first guide rails 86 and the cap tray 81. Each of the first tray support members 88 has a front end portion 88*a*, a rear end portion 88*b*, and a connecting portion 91 that connects the front end portion 88*a* and the rear end portion 88*b* thereof. Each of the front end portions 88*a* and the rear end portions 88*b* is formed with a guide 92 that protrudes upward therefrom. The guides 92 are inserted into through holes 81*a* formed in four corners of the cap tray 81.

Three springs 93 (an example of a first elastic member) are provided on an upper surface of each of the connecting portions 91, at regular intervals in the sub scanning direction, at respective positions opposite to each of the first guide rails 86. Thus, a total of six springs 93 are provided to support the bottom of the cap tray 81. Therefore, the cap tray 81 is upwardly urged by the springs 93 while guided by the four guides 92. With this structure, the caps 84 can contact the respective ink ejection surfaces 3*a*. In addition, the springs 93 can absorb a shock occurring when the ink ejection surfaces 3*a* and the caps 84 contact each other. As a result, damage to the ink ejection surfaces 3*a* due to the contact of the caps 84 and the ink ejection surfaces 3*a* can be minimized.

Each of the rear end portions 88*b* of the first tray support members 88 is formed with an engaging hook 94 (an example of an engaging member). The engaging hooks 91 of the rear end portions 88*b* of the first tray support members 88 are configured to engage with the respective first tray support members 89. The front end portion 88*a* and the rear end portion 88*b* of one of the first tray support member 88 (the left first tray support member 88 in FIG. 5 in this embodiment) are formed with fixed portions 88*c*, 88*d*, respectively. The fixed portions 88*c*, 88*d* are fixed to the timing belt 90 by screws. The timing belt 90 is driven by a cap motor 128 (which may be a common motor) (see FIG. 7) to travel in a forward direction (in a direction that the cap tray 81 is moved toward a capping position) and in a backward direction (in a direction that the cap tray 81 is moved toward the cap tray retracted position).

The pair of second tray support members 89 are disposed between each of the second guide rails 87 and the cap tray 82. Each of the second tray support members 89 has a front end portion 89*a*, a rear end portion 89*b*, and a connecting portion 95 that connects the front end portion 89*a* and the rear end portion 89*b*. Each of the front end portions 89*a* and the rear end portions 89*b* is formed with a guide 96 that protrudes upward. The guides 96 are inserted into through holes 82*a* formed in four corners of the cap tray 82. The guides 92 of the second tray support members 89 are shorter in height than the guides 96 of the first tray support members 88.

Three springs 97 (an example of a second elastic member) are provided on an upper surface of each of the connecting portions 95, at regular intervals with respect to the sub scanning direction, at respective positions opposite to each of the second guide rails 87. Thus, a total of six springs 97 are provided to support the bottom of the cap tray 97. That is, the cap tray 82 is upwardly urged by the springs 97 while guided by the four guides 96. The springs 97 have a spring constant which is greater than that of the springs 93, and has a free length which is shorter than that of the springs 93. The cap trays 81, 82 are supported at the different levels. The cap trays 81, 82 are configured such that a contact force between each of the caps 84 and each of the corresponding ink ejection surfaces 3*a* and a contact force between each of the caps 85 and each of the corresponding ink ejection surfaces 3*a* becomes substantially the same when the caps 84, 85 make contact with the respective ink ejection surfaces 3*a* at the same time. The springs 97 can absorb a shock occurring from the contact between the ink ejection surfaces 3*a* and the caps 85. As a result, damage to the ink ejection surfaces 3*a* due to the contact of the caps 85 and the ink ejection surfaces 3*a* can be prevented. In addition, even when the cap trays 81, 82 are located at the different levels, the contact force between each of the caps 84 and each of the corresponding ink ejection surfaces 3*a* and the contact force between each of the caps 85 and each of the corresponding ink ejection surfaces 3*a* can be substantially the same.

The springs 93 are disposed on the respective connecting portions 91 at the positions opposite to the respective first guide rails 86. Further, the springs 97 are disposed on the respective connecting portions 95 at the positions opposite to the respective second guide rails 87 that are provided between the first guide rails 86. Therefore, the both ends of each of the cap trays 81, 82 in the main scanning direction are located at the positions opposite to the corresponding guide rails 86, 87. Accordingly, the springs 93 do not interfere with the cap tray 82 even when the cap trays 81, 82 are arranged one above the other in the overlapping direction at the cap tray retracted position.

Each of the front end portions 89*a* of the second tray support members 89 is formed with a projection 98 (an example of a second transmission mechanism or an engaged portion). The projections 98 of the front end portions 89*a* of the second tray support members 89 are configured to engage with the engaging hooks 94 of the rear end portions 89*b* of the first cap tray support members 88 when the cap tray 81 is moved toward the front to allow all of the caps 84, 85 to be arranged so as to correspond to and align with the ink ejection surfaces 3*a* with respect to the sub scanning direction (e.g. the caps 84, 85 are arranged at the capping position where the eight caps 84, 85 on the cap trays 81, 82 face the respective ink ejection surfaces 3*a*). Each of the rear end portions 89*b* of the second tray support members 89 is formed with a projection 99 (an example of a second transmission mechanism or an engaged portion). The projections 99 of the rear end portions 89*b* of the second tray support members 89 are configured to engage with the respective engaging hooks 94 of the front end portions 88*b* of the first tray support members 88 when the cap tray 81 is moved toward the rear to allow the cap trays 81, 82 to be arranged in a positional relationship where the cap trays 91, 82 are arranged one above the other the overlapping direction (e.g. the cap trays 81, 82 are arranged in a positional relationship that is the same as the cap tray retracted position shown in FIG. 1).

With this structure, as the timing belt 90 runs in the forward direction, the pair of first tray support members 88 and the cap tray 81 move toward the right in FIG. 1 (toward the front), that is from the cap tray retracted position to the capping position. Before the cap tray 81 reaches the capping position, the engaging hooks 94 of the cap tray 81 and the projections 98 of the cap tray 82 engage with each other. Therefore, the pair of second tray support members 89 and the cap tray 82 move toward the capping position together with the cap tray 81. As the timing belt 90 runs in the backward direction, the pair of first tray support members 88 and the cap tray 81 move toward the left in FIG. 1 (toward the rear), that is from the capping position to the cap tray retracted position. Before the cap tray 81 reaches the cap tray retracted position, the engaging hooks 94 of the cap tray 81 and the projections 99 of the cap tray 82 engage with each other. Therefore, the pair of second tray support members 89 and the cap tray 82 move toward the cap tray retracted position together with the cap tray 81.

Because the cap tray moving mechanism 83 includes the above-described engaging hooks 94 and the projections 98, 99, the second tray support members 89 can be moved by moving just which the first tray support members 88. Therefore, the cap tray 82 can be moved just by moving cap tray 81. Accordingly, movement and overlapping of the trays 81, 82 moving mechanism 83 can be easily performed Next, a control system of the inkjet printer 1 will be described with reference to FIG. 7. The inkjet printer 1 includes a control portion 101 that controls various operations of the inkjet printer 1. The control portion 101 includes a CPU (central processing unit) that is an arithmetic processing unit, a ROM (read only memory) that stores a control program to be executed by the CPU and data to be used in the control program, and a RAM (random access memory) that temporarily stores data at the execution of the program. The control portion 101 further includes a head control portion 111, a conveyance control portion 112, and a maintenance control portion 113.

The head control portion 111 controls a head drive circuit 121 to allow corresponding inkjet heads 2 to eject ink therefrom when the control portion 101 has received print data from a PC (personal computer) 100.

The conveyance control portion 112 controls a motor driver 122 to allow the pickup roller 22 to rotate to covey a sheet onto the conveyor belt 8 while controlling a motor driver 123 to drive the conveyor motor 133 to further convey the sheet placed on the conveyor belt 8, when the control portion 101 has received print data from the PC 100.

The maintenance control portion 113 includes a pump control portion 116, a head movement control portion 117 (an example of a liquid ejection head movement control portion), a waste liquid tray movement control portion 118 (an example of a maintenance tray movement control portion), and a cap tray movement control portion 119 (an example of a maintenance tray movement control portion). The pump control portion 116 controls a pump driver 124 to drive an ink supply pump 134 to forcefully supply the ink to the inkjet heads 2 when the purge operation is necessary. For example, such purge operations may be necessary when ink is introduced to the inkjet heads 2 at the first time or when a printing is performed after a long period of time. A maintenance operation to be performed on the inkjet heads 2 includes the purge operation.

The head movement control portion 117 controls a motor driver 125 to drive the head motor 52 to allow the eight inkjet heads 2 to move from the printing position to a head standby position (described later) when the purge operation is necessary. The head movement control portion 117 also controls the motor driver 125 to drive the head motor 52 to allow the eight inkjet heads 2 to move from the head standby position to the printing position when the maintenance operation on the inkjet heads 2 is finished.

The waste liquid tray movement control portion 118 controls a motor driver 127 to drive a tray motor 126 to allow the waste liquid trays 61, 62 to move the ink receiving position before the purge operation is started. The waste liquid tray movement control portion 118 also controls a motor driver 127 to drive the tray motor 126 to allow the waste liquid tray 61 and the waste liquid tray 62 to move to the waste liquid tray retracted position when the purge operation is finished.

The cap tray movement control portion 119 drives a cap motor 128 to control a motor driver 129 to allow the cap trays 81, 82 to move to the capping position when a printing operation has not been performed on the inkjet printer 1 for longer than a predetermined period of time. The cap tray movement control portion 119 also drives the cap motor 128 to control the motor driver 129 to allow the cap trays 81, 82 to move to the cap tray retracted position when a printing operation is started upon receipt of print data by the control portion 101 from the PC 100.

Next, the maintenance operation performed by the maintenance unit 60 will be described with reference to FIGS. 8A to 9C.

When the purge operation is performed to introduce ink to the inkjet heads 2 for the first time or to fix the inkjet heads 2 having an ejection failure, the head movement control portion 117 drives the head motor 52 via the motor driver 125 to upwardly move the eight inkjet heads 2 (e.g. the head unit 15) to the head standby position. Then, when the head unit 15 has reached the head standby position, the head movement control portion 117 stops the head motor 52 via the head driver 125. At that time, a space is provided between the ink ejection surfaces 3*a* and the conveyor belt 15 such that the maintenance unit 60 can be placed within the space. When the head unit 15 is located at the head standby position, the ink ejection surfaces 3*a* of the inkjet heads 2 and the bottom surface of the head frame 4 are located at a level so that they will not be in contact with the wiper 64 even if the waste liquid trays 61, 62 are located at the ink receiving position (see FIG. 8B).

Figure 8A:
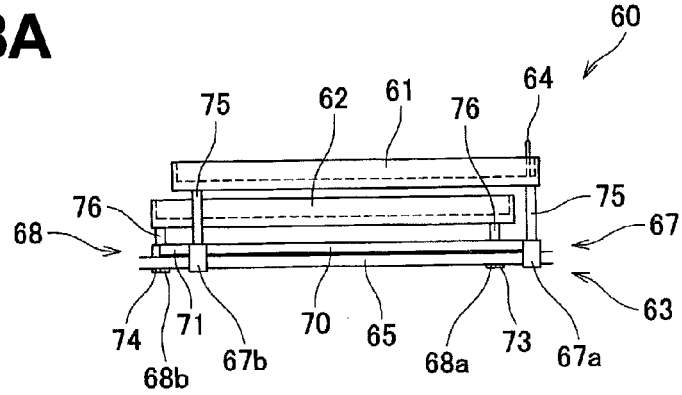
FIG. 8A illustrates the maintenance unit, wherein the waste liquid trays are located at a waste liquid tray retracted position.
Figure 8B:
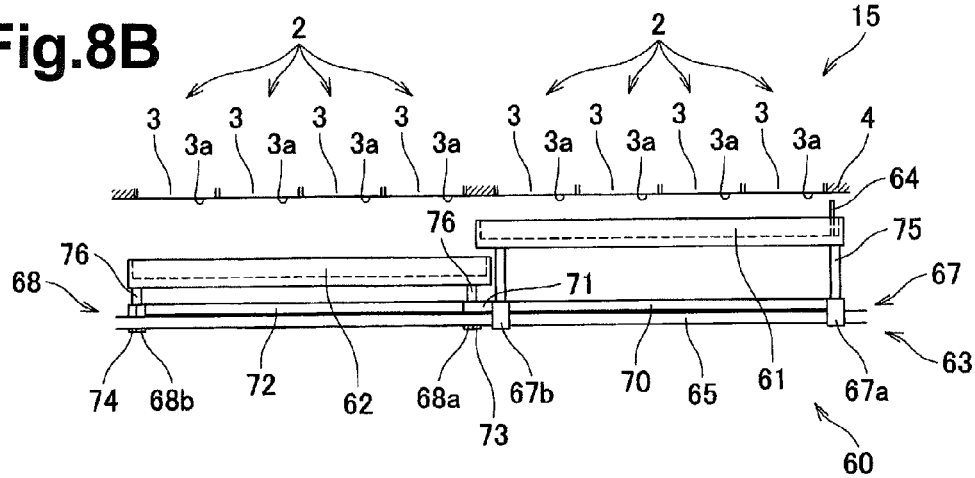
FIG. 8B illustrates the maintenance unit, wherein the waste liquid trays are located at an ink receiving position.
Figure 8C:
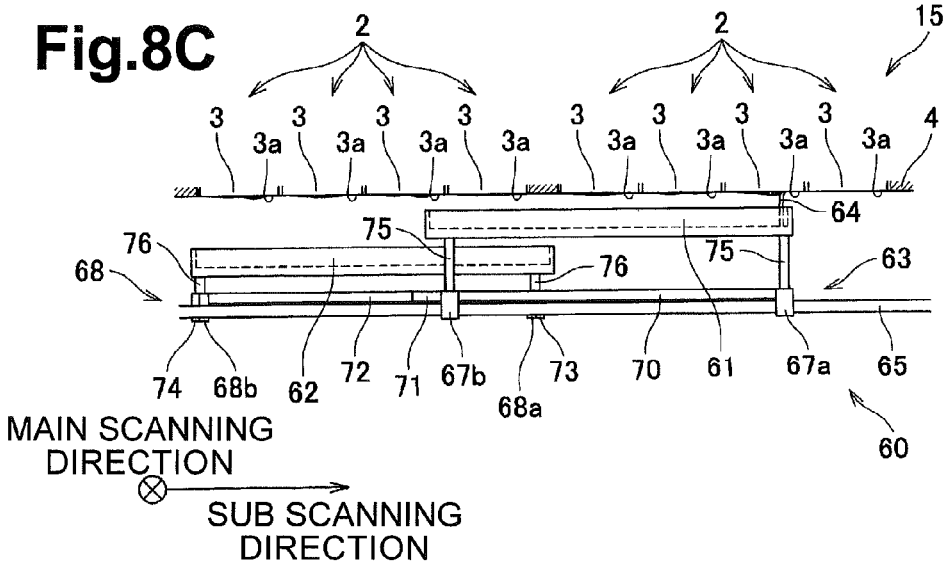
FIG. 8C illustrates the maintenance unit, wherein ink ejection surfaces are being wiped by a wiper.

The waste liquid tray movement control portion 118 drives the tray motor 126 via the motor driver 127 to move the waste liquid tray 61 toward the right (toward the front) in FIG. 8A from the waste liquid tray retracted position shown in FIG. 8A to the ink receiving position. During the movement of the waste liquid tray 61, tray 62 remains stationary until the engaging hooks 71 of the waste liquid tray 61 engages the projections 73 of the waste liquid tray 62. Once the hooks 71 and projections 73 are engaged, the trays 61, 62 move together to their ink receiving position. The hooks 71 and projections 73 are spaced on the trays 61, 62 such that they engage when the trays 61, 62 are positioned with respect to one another as they would be at the ink receiving position. Thus, the waste liquid tray 62 moves towards the right via the waste liquid tray 61, which is moved by the tray motor 126. Then, when both of the waste liquid trays 61, 62 have reached the ink receiving position as shown in FIG. 8B, the waste liquid tray movement control portion 118 stops the tray motor 126 via the motor driver 127.

Next, the pump control portion 116 drives the ink supply pump 134 via the pump driver 124 to forcefully supply ink to the inkjet heads 2 to eject the ink from the nozzles 3*b* of the inkjet heads 2 onto the waste liquid trays 61, 62. By performing the purge operation, nozzles experiencing ejection failure due to clogging of the nozzles 3*b* or an increase in viscosity of ink existing in the nozzles 3*b*, can be resolved, thereby restoring ink ejection properties of the inkjet heads 2. The operation for the initial ink introduction into the inkjet heads 2 will be performed in a substantially similar manner to the purge operation described above.

Then, the head movement control portion 117 drives the head motor 52 via the motor driver 125 to rotate the pinion gears 55 to move the head unit 15 downward. When the bottom surface of the head frame 4 and the tip of the wiper 64 have made contact with each other, the head movement control portion 117 stops the head motor 52 via the motor driver 125.

After that, the waste liquid tray movement control portion 118 drives the tray motor 126 via the motor driver 127 to move the waste liquid tray 61 toward the left (toward the rear)

whereby the wiper 64 will wipe ink adhered to the ink ejection surfaces 3*a*. During the movement of the waste liquid tray 61, when the wiper 64 finishes wiping all of the ink ejection surfaces 3*a* of the inkjet heads 2 belonging to the first head group 3*x*, the engaging hooks 71 of the waste liquid tray 61 and the projections 74 of the waste liquid tray 62 engage with each other. The wiper 64 wipes the ink ejection surfaces 3*a* of the inkjet heads 2 belonging to the second head group 3*y* while the waste liquid trays 61, 62 are arranged one above the other in the overlapping direction as in the waste liquid tray retracted position. When the wiping of all of the eight ink ejection surfaces 3*a* by the wiper 64 is completed and the both waste liquid trays 61, 62 reached the waste liquid tray retracted position, the waste liquid tray movement control portion 118 stops the tray motor 126 via the motor driver 127. This completes the maintenance operation performed by the maintenance unit 60 according to the purge operation.

When the maintenance operation is completed, the head movement control portion 117 drives the head motor 52 via the motor driver 125 to move the head unit 15 downward. Then, when the inkjet head 2 reaches the printing position, the head movement control portion 117 stops the head motor 52 via the motor driver 125.

Figure 9A:
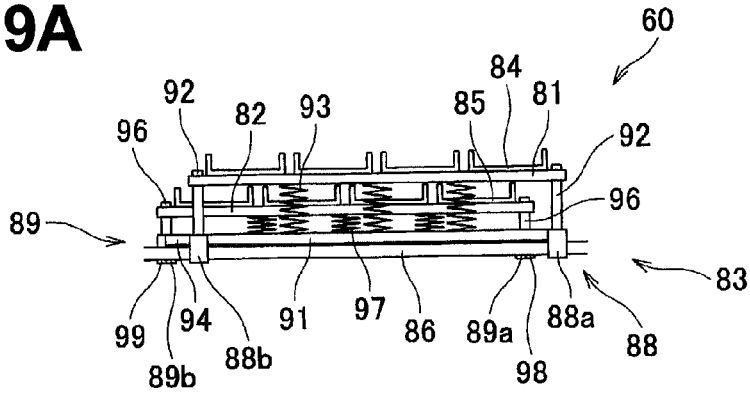
FIG. 9A illustrates the maintenance unit, wherein the cap trays are located at a cap tray retracted position.
Figure 9B:
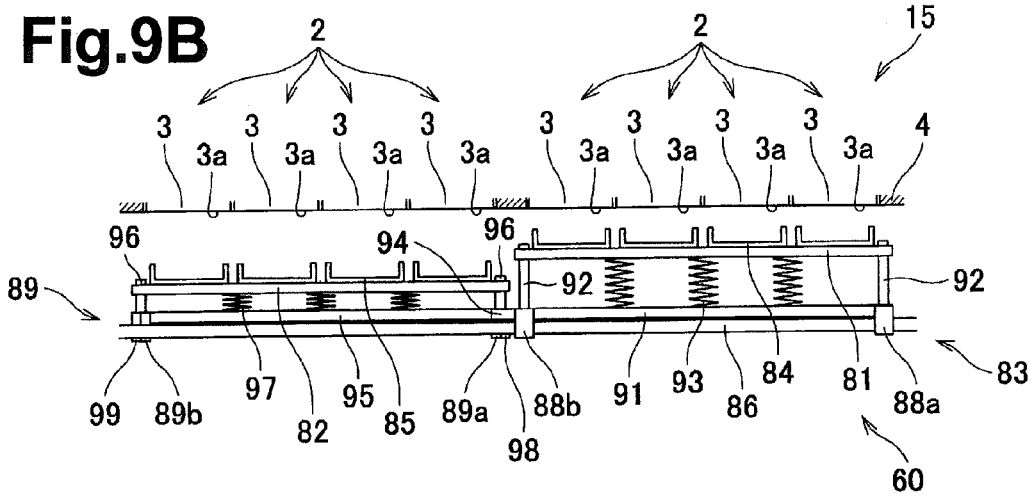
FIG. 9B illustrates the maintenance unit, wherein the cap trays are located at a capping position.

Next, a capping operation for covering all of the eight ink ejection surfaces 3*a* with the respective caps 84, 85 will be described. When a printing operation has not been performed for longer than a predetermined period of time, the capping operation is performed to cap the ink ejection surfaces 3*a* with the caps 84, 85 to prevent drying of the ink in the nozzles 3*b*. Similar to the case of the waste liquid tray 61, the head movement control portion 117 moves the head unit 15 to the head standby position. The cap tray movement control portion 119 drives the cap motor 128 via the motor driver 129 to move the cap trays 81, 82 toward the right (toward the front) in FIG. 9A from the cap tray retracted position shown in FIG. 9A to the capping position. During the movement of the cap tray 81, when the eight caps 84, 85 on the cap trays 81, 82 reach a position corresponding to and aligned with all of the ink ejection surfaces 3*a*, the engaging hooks 94 of the cap tray 81 and projections 98 of the cap tray 82 are engaged with each other. Therefore, the cap motor 128 moves the cap tray 81 which, in turn, moves the cap tray 82 toward the right. Then, when both of the cap trays 81, 82 have reached the capping position as shown in FIG. 9B, the cap tray movement control portion 119 stops the cap motor 128 via the motor driver 129.

Figure 9C:
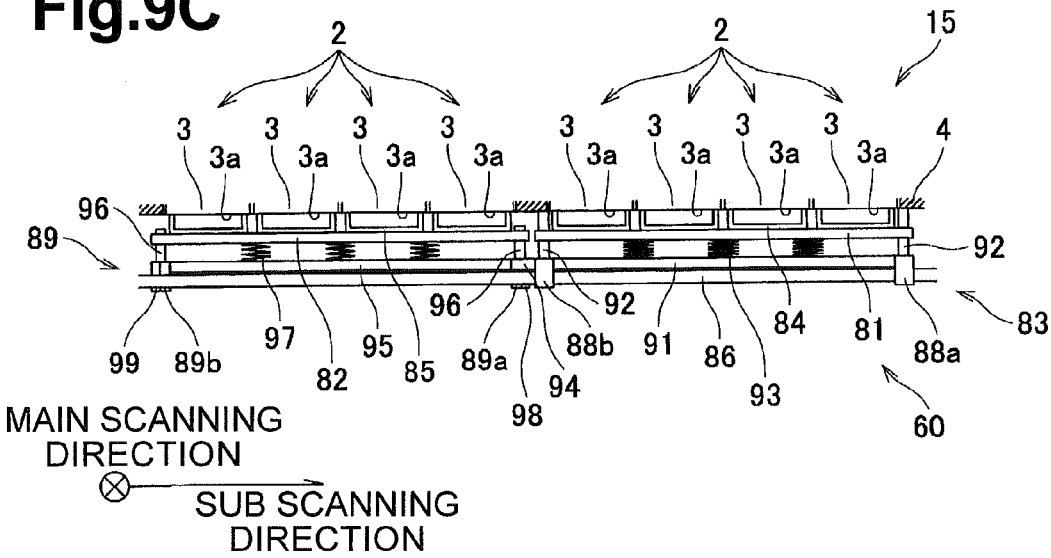
FIG. 9C illustrates the maintenance unit, wherein caps of the cap trays contact with corresponding ink ejection surfaces.

Next, the head movement control portion 117 drives the head motor 52 via the motor driver 125 to move the head unit 15 downward. At that time, as shown in FIG. 9C, the ink ejection surfaces 3*a* of the inkjet heads 2 belonging to the first head group 3*x* are put into contact with the corresponding caps 84, and the ink ejection surfaces 3*a* of the inkjet heads 2 belonging to the second head group 3*y* are then put into contact with the corresponding caps 85. After that, the head movement control portion 117 stops the head motor 52 via the motor driver 125. The contact force between each of the ink ejection surfaces 3*a* and each of the corresponding caps 84 is substantially the same as the contact force between each of the ink ejection surfaces 3*a* and each of the corresponding caps 85. As described above, the drying of the ink in the nozzles 3*b* can be prevented by capping the ink ejection surfaces 3*a* with the caps 84, 85.

When a printing operation is started upon receipt of print data by the control portion 101 from the PC 100, the head movement control portion 117 drives the head motor 52 via the motor driver 125 to move the head unit 15 upward. Then, when the head unit 15 has reached the head standby position, the head movement control portion 117 stops the head motor 52 via the motor driver 125 to hold the head unit 15 at the head standby position.

Then, the cap tray movement control portion 119 drives the cap motor 128 via the motor driver 129 to move the cap tray 81 toward the left (toward the rear). When the cap trays 81, 82 are aligned one above the other in the overlapping direction such as when the cap trays 81, 82 are located at the cap tray retracted position, the engaging hooks 94 of the cap tray 81 and the engaged potions 99 of the cap tray 82 are engaged with each other and the cap tray 81 moves to the cap tray retracted position and pulls the cap tray 82. When the cap trays 81, 82 have reached the cap tray retracted position, the cap tray movement control portion 119 stops the cap motor 128 via the motor driver 129. This completes the maintenance operation performed by the maintenance unit 60. After that, the head unit 15 is moved downward to position it at the printing position, and the printing operation may be performed.

According to the inkjet printer 1 of the first illustrative embodiment, the waste liquid trays 61, 62 are arranged one above the other at the different levels in the waste liquid tray retracted position. The waste liquid tray 61 corresponds to the four inkjet heads 2 belonging to the first head group 3*x* and the waste liquid tray 62 corresponds to the other four inkjet heads 2 belonging to the second head group 3*y*. With this structure, the width of each of the waste liquid tray 61, 62 with respect to the sub scanning direction can be narrowed to an approximately half of a width of a single waste liquid tray for eight inkjet heads. Accordingly, the inkjet printer 1 can be downsized.

The cap trays 81, 82 including the caps 84, 85, respectively, are also arranged one above the other at different levels in the cap tray retracted position. Therefore, the width of each of the cap trays 81, 82 with respect to the sub scanning direction can be also narrowed, so that the inkjet printer 1 can be downsized. In addition, the ink can be prevented from increasing in viscosity and from solidifying in the nozzles 3*b* by contacting the caps 84, 85 with the respective ink ejection surfaces 3*a*.

Even when the eight inkjet heads 2 are divided into the two head groups 3*x*, 3*y* of adjacent four inkjet heads 2, the wiper 64 wipes ink from the ink ejection surfaces 3*a* one by one. Accordingly, the mixing of different colors of ink on the ink ejection surfaces 3*a* during the wiping is substantially prevented. In addition, after the ink ejection surface 3*a* is wiped, a predetermined time for the ink wiped from an ink ejection surface 3*a* to run down from the tip of the wiper 64 is allowed before a next adjacent ink ejection surface 3*a* is to be wiped. By doing so, the mixing of the different colors of ink can be prevented on the ink ejection surfaces 3*a*. The wiper 64 can be moved while the wiped ink runs down from the tip of the wiper 64. In this case, the wiper 64 may be configured to move at slow speed.

Next, an inkjet printer 1 according to a second illustrative embodiment of the invention will be described with reference to FIGS. 10, 11A and 11B, wherein like parts and components are designated by the same reference numerals.

The inkjet printer 1 of the second illustrative embodiment has the same structure as that of the inkjet printer 1 of the first illustrative embodiment, except it includes first and second wiping members, two wipers 264, 265, respectively in the waste liquid tray 61. As shown in FIG. 10, each of the wipers 264, 265 has a length that is a half of the wiper 64 of the first illustrative embodiment with respect to the main scanning direction. The wipers 264, 265 are disposed at the front and rear end portions of the waste liquid tray 61, respectively.

Figure 10:
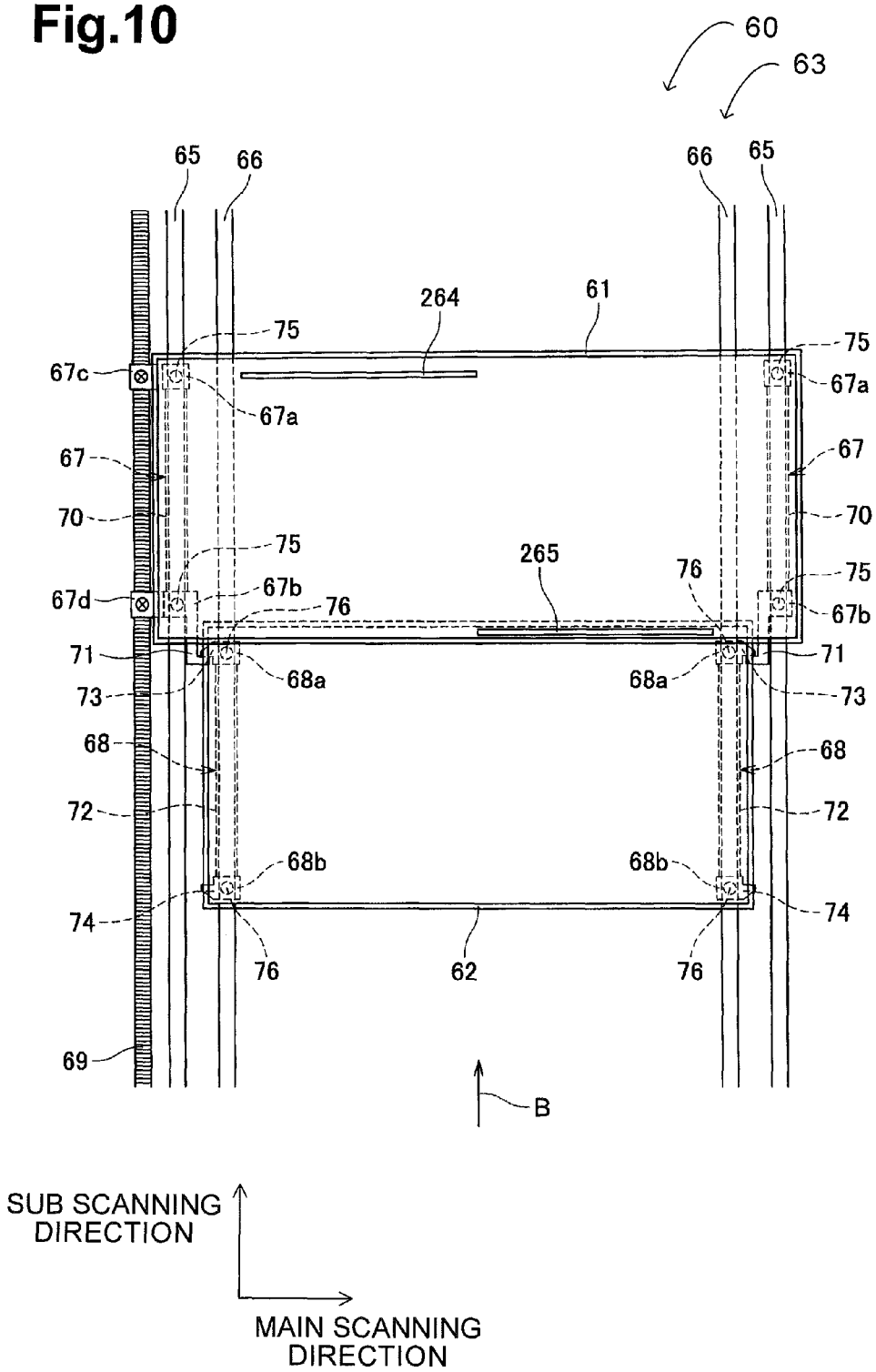
FIG. 10 is a plan view of a maintenance unit including two waste liquid trays and a waste liquid tray moving mechanism for moving the waste liquid trays, according to a second illustrative embodiment of the invention.
Figure 11A:
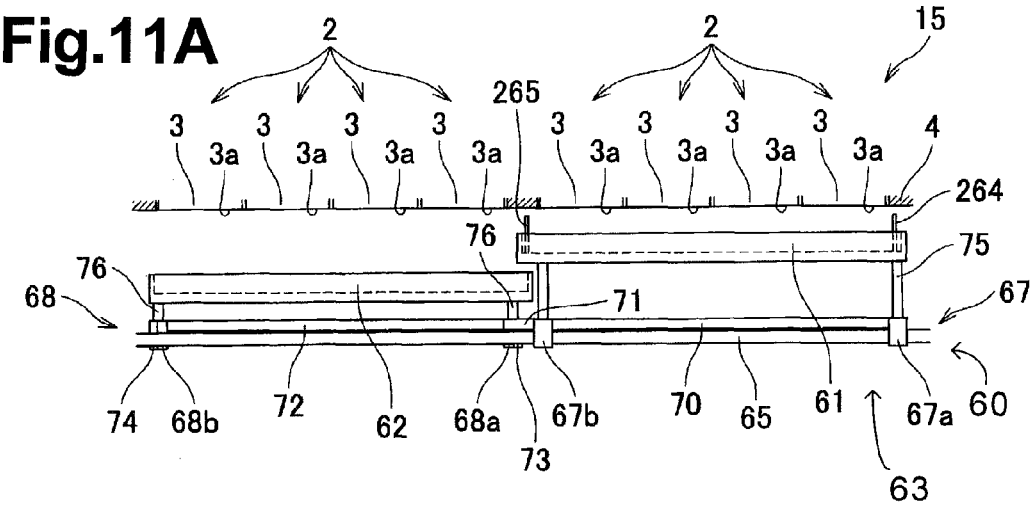
FIG. 11A illustrates the maintenance unit of FIG. 10, wherein the waste liquid trays are located at the ink receiving position.
Figure 11B:
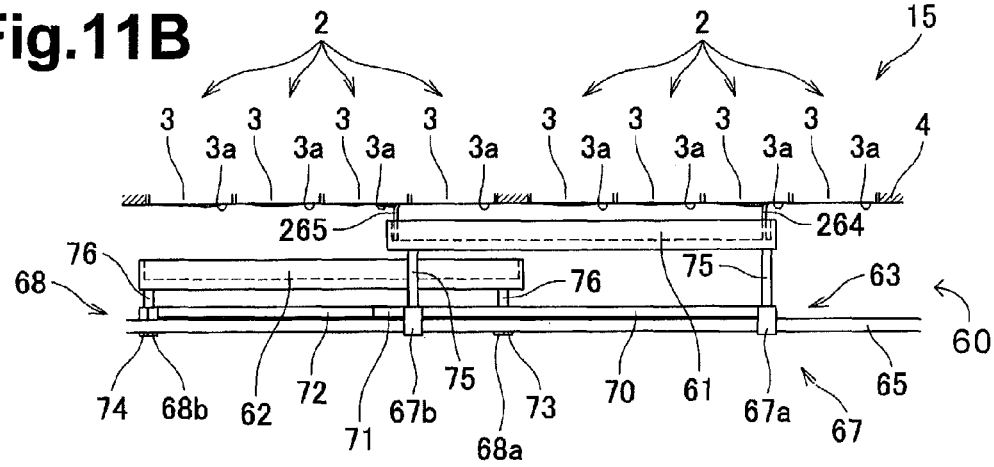
FIG. 11B illustrates the maintenance unit of FIG. 10, wherein the ink ejection surfaces are being wiped by wipers.

The wiper 264 and the wiper 265 are disposed at the left part and the right part of the waste liquid tray 61, respectively, with respect to the center line extending along the sub scanning direction in FIG. 10. As shown in FIG. 11A, the wiper 264 faces a bottom surface of the head frame 4 at its farthest position from the waste liquid tray retracted position and the wiper 265 faces a bottom surface of the head frame 4 at its middle position when the waste liquid tray 61 is located at the ink receiving position. The wiper 264 is used to wipe the ink ejection surfaces 3*a* of the inkjet heads 2 belonging to the first head group 3*x* and the wiper 265 is used to wipe the ink ejection surfaces 3*a* of the inkjet heads 2 belonging to the second head group 3*y*.

Next, a maintenance operation performed by the maintenance unit 60, including the purge operation for an initial ink introduction into the inkjet heads 2 and the purge operation for a restoration of the inkjet heads 2 experiencing an ejection failure, will be described. Similar to the first illustrative embodiment, at those operations, the waste liquid trays 61, 62 are moved to the ink receiving position and then ink is ejected onto the waste liquid trays 61, 62 from the inkjet heads 2. After that, the head unit 15 is moved downward to make the bottom surface of the head frame 4 contact the tips of the wipers 264, 265.

Then, the waste liquid tray 61 is moved toward the left. At that time, as shown in FIG. 11B, the wiper 264 wipes the ink ejection surfaces 3*a* of the inkjet heads 2 belonging to the first head group 3*x* and the wiper 265 wipes the wipes the ink ejection surfaces 3*a* of the inkjet heads 2 belonging to the second head group 3*y* at the same time. Therefore, a time for wiping all of the eight ink ejection surfaces 3*a* with the two wipers 264, 265 is shorter than the time for wiping all of the eight ejection surfaces 3*a* with the single wiper 64 of the first illustrative embodiment.

When the wiping of the ink ejection surfaces 3*a* with the wipers 254, 265 is finished, the waste liquid tray movement control portion 118 increases a rotation speed of the tray motor 126 via the motor driver 127 to move the waste liquid tray 61, 62 to the waste liquid tray retracted position at high speed. When the waste liquid trays 61, 62 have reached the waste liquid tray retracted position, the waste liquid tray movement control portion 118 stops the tray motor 126 via the motor driver 127. Thus, the maintenance operation of the maintenance unit 60 according to the purge operation is finished.

In the inkjet printer 1 according to the second illustrative embodiment described above, the same effects as those obtained in the first illustrative embodiment can be obtained in the same structure. In addition, the maintenance time according to the second illustrative embodiment becomes shorter than that of the first illustrative embodiment. In the first illustrative embodiment, even if the rotation speed of the tray motor 126 is increased to move the waste liquid trays 61, 62 to the waste liquid tray retracted position after the wiper wipes all of the eight ink ejection surfaces 3*a*, the time for wiping in the first illustrative embodiment is still longer than that in the second illustrative embodiment. Accordingly, the time for moving the waste liquid trays 61, 62 from the ink receiving position to the waste liquid tray retracted position in the first illustrative embodiment is longer than that in the second illustrative embodiment.

Figure 12:
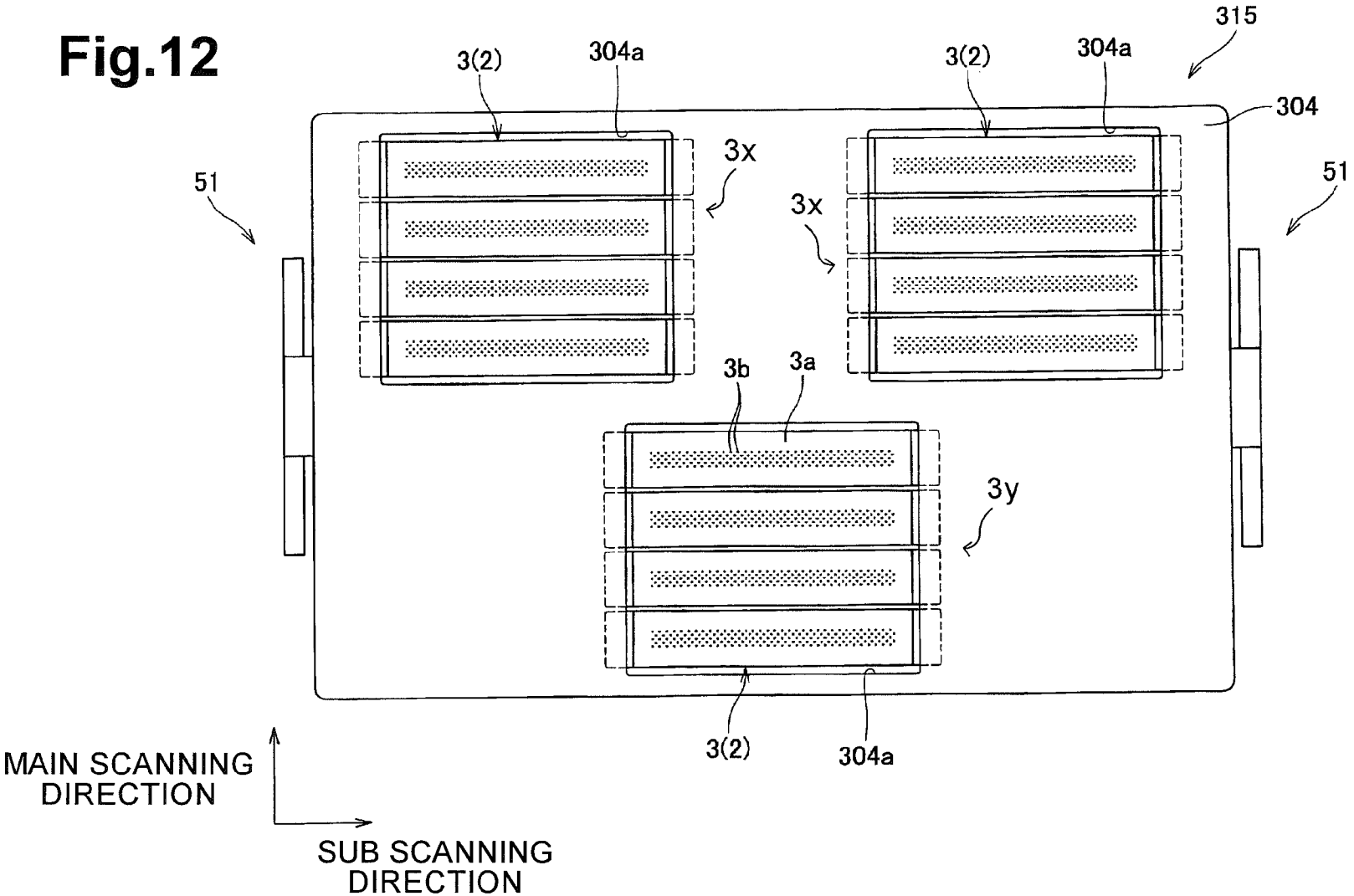
FIG. 12 is a plan view of a head unit according to a variation of the invention.

In the first and second illustrative embodiments, each of the inkjet printers 1 includes the eight inkjet heads 2 belonging to the two head groups 3*x*, 3*y* as shown in FIG. 2. However, the inkjet printer 1 may have another four inkjet heads 2 as shown in FIG. 12. A variation of the head unit 15 will be described below, wherein like parts and components are designated by the same reference numerals.

As shown in FIG. 12, a head unit 315 includes a head frame 304 elongated in the main scanning direction and twelve inkjet heads 2. The head frame 304 is provided with two frame moving mechanisms 51 at both ends in the main scanning direction. The head unit 315 is vertically movable by the frame moving mechanisms 51. The head frame 304 has three through portions 304*a*, which are formed in a staggered arrangement in the main scanning direction.

The twelve inkjet heads 2 are divided into three head groups of four inkjet heads 2 each: a first head group 3*x*, a second head group 3*y*, and a third head group 3*x*. In each of the head groups 3*x*, 3*y*, four adjacent ink ejection surfaces 3*a* are aligned in the sub scanning direction so as to be disposed close to each other without being displaced in the main scanning direction. The inkjet heads 2 belonging to the respective head groups 3*x*, 3*y* are fixed to the head frame 304 while their ink ejection surfaces 3*a* are exposed by the respective through portions 304*a*. The first to third head groups 3*x*, 3*y* are displaced from each other with respect to the sub scanning direction so as to be provided in a staggered arrangement. The ink ejection surfaces 3*a* in the adjacent head groups 3*x*, 3*y* overlap each other in the sub scanning direction such that printable areas of the adjacent head groups 3*x*, 3*y* continue to one another to constitute a single printable area in the head unit 315. That is, the inkjet printer of the variation has a length of a printable area that is approximately one-and-half times wider than the length of the printable area of the inkjet printer 1 according to the first and second illustrative embodiments. When the length of the printable area of the inkjet printer 1 according to the first and second illustrative embodiments corresponds to a length of a printing area of an A4-sized sheet, the length of the printable are of the inkjet printer according to the variation corresponds to a length of a printing area of an A3-sized sheet. Accordingly, in the inkjet printer of the variation, ink can be ejected onto the almost entire area of a large sheet.

The inkjet printer having the above-described head unit 315 has a waste liquid tray corresponding to the two head groups 3*x* that are provided at a position that is far from the waste liquid tray retracted position (the two head groups indicated at an upper area of the head unit 315 in FIG. 12) and a waste liquid tray corresponding to the other head group 3*y* (the head group indicated at a lower area of the head unit 315 in FIG. 12). Therefore, the inkjet printer can be downsized regardless of the size of the head unit 315.

In the variation described above, the three head groups are arranged in the staggered arrangement in the main scanning direction, however, four head groups may be arranged in the staggered arrangement in the sub scanning direction. In this case, eight inkjet heads are disposed at the left part of the head unit and another eight inkjet heads are disposed at the right part of a head unit, with respect to the center line extending along the sub scanning direction. Eight different colors of ink are filled in the eight inkjet heads 2 at the left part and the same eight different colors of ink are filled in the other eight inkjet heads 2 at the right part. By doing so, color representation in the inkjet printer is further increased.

The inkjet printer may include a waste liquid tray corresponding to a head group that is provided at a position that is farthest from the waste liquid tray retracted position and a head group adjacent to the farthest head group and a waste liquid tray corresponding to the other two head groups. By doing so, the inkjet printer for multicolor printing can be downsized.

While the invention has been described in detail with reference to the specific embodiments thereof, it would be apparent to those skilled in the art that various changes, arrangements and modifications may be applied therein without departing from the spirit and scope of the invention. For example, an inkjet printer may include at least two inkjet heads. In this case, the inkjet printer may include a waste liquid tray corresponding to the inkjet head provided at a position that is far from the waste liquid tray retracted position and a waste liquid tray corresponding to the other inkjet head. With this structure, the inkjet printer can be downsized. The above-described inkjet printers may not have the cap trays 81, 82 and the cap moving mechanism 83. The waste liquid tray moving mechanism 63 may move the waste liquid trays 61, 62 independently between the waste liquid tray retracted position and the ink receiving position. In this case, it is unnecessary to form the engaging hooks 71 and the projections 73, 74 at the first and second tray support members 67, 68. The cap tray moving mechanism 83 may move the cap trays 81, 82 independently between the cap tray retracted position and the capping position. In this case, the engaging hooks 94 and the projection 98, 99 are unnecessary to be formed at the first and second tray support members 88, 89. The waste liquid tray moving mechanism 63 and the cap tray moving mechanism 83 may have other functions if the both mechanisms 63, 83 are capable of at least moving the waste liquid trays 61, 62 and the cap trays 81, 82, respectively, in the sub scanning direction.

The features described herein have been applied to the inkjet printer having the plurality of inkjet heads for ejecting ink from the nozzles. The scope of the application is, however, not limited to the inkjet heads described above. For example, these features can be applied to various liquid ejection devices having a plurality of liquid ejection heads, such as devices for ejecting conductive paste onto a substrate to form fine wiring patterns thereon, for ejecting organic emitter material onto a substrate to form a high-resolution display, or for ejecting optical resin onto a substrate to form microelectronic devices, such as optical waveguides.

What is claimed is:

1. A liquid ejection device comprising:

a plurality of liquid ejection heads each having a liquid ejection surface that is elongated in a main scanning direction and is formed with a plurality of liquid ejection ports, wherein the plurality of liquid ejection surfaces define a first liquid ejection area and a second liquid ejection area;

a recording medium conveyor mechanism configured to convey a recording medium in a sub scanning direction to pass the recording medium through an area facing the plurality of liquid ejection surfaces;

a maintenance unit, including:

a first maintenance tray;

a second maintenance tray; and a maintenance tray moving mechanism configured to move the first maintenance tray and the second maintenance tray in a predetermined direction, the maintenance tray moving mechanism configured to move the first maintenance tray between a first maintenance position where the first maintenance tray faces the first liquid ejection area and a first non-maintenance position which is away from the first maintenance position in the predetermined direction, the maintenance tray moving mechanism configured to move the second maintenance tray between a second maintenance position where the second maintenance tray faces the second liquid ejection area and a second non-maintenance position which is away from the second maintenance position in the predetermined direction; and a maintenance tray movement control portion configured to control the maintenance tray movement mechanism to move the first maintenance tray and the second maintenance tray, wherein the first maintenance tray located at the first non-maintenance position and the second maintenance tray located at the second non-maintenance position at least partially overlap each other when viewed from a direction perpendicular to both the main scanning direction and the sub scanning direction.

2. The liquid ejection device according to claim 1, wherein the predetermined direction is the sub scanning direction.

3. The liquid ejection device according to claim 1, wherein the first maintenance tray located at the first non-maintenance position is located above and covers at least a part of the second maintenance tray located at the second non-maintenance position.

4. The liquid ejection device according to claim 3, wherein a distance between the first maintenance position and the first non-maintenance position is longer than a distance between the second maintenance position and the second non-maintenance position.

5. The liquid ejection device according to claim 1, wherein the first maintenance tray includes a first waste liquid tray, and the second maintenance tray includes a second waste liquid tray.

6. The liquid ejection device according to claim 1, wherein the first maintenance tray includes a first cap tray, and the second maintenance tray includes a second cap tray.

7. The liquid ejection device according to claim 1, wherein the maintenance tray moving mechanism includes a common motor that moves the first maintenance tray and the second maintenance tray in the predetermined direction.

8. The liquid ejection device according to claim 7, wherein the maintenance tray moving mechanism includes:

a first transmission mechanism configured to transmit a drive force of the common motor to the first maintenance tray; and a second transmission mechanism configured to transmit a drive force generated by the movement of the first maintenance tray to the second maintenance tray.

9. The liquid ejection device according to claim 8, wherein the maintenance tray moving mechanism is configured such that the second maintenance tray is moved to the second maintenance position by the movement of the first maintenance tray to the first maintenance position and the second maintenance tray is moved to the second non-maintenance position by the movement of the first maintenance tray to the first non-maintenance position.

10. The liquid ejection device according to claim 9, wherein the second transmission mechanism includes:

an engaging member provided at one of the first maintenance tray and the second maintenance tray; and a first engaging portion and a second engaging portion provided at the other of the first maintenance tray and the second maintenance tray, wherein a positional relationship between the engaging member and the first engaging portion defines a positional relationship between the first maintenance position and the second maintenance position, and a positional relationship between the engaging member and the second engaging portion defines a positional relationship between the first non-maintenance position and the second non-maintenance position.

11. The liquid ejection device of claim 1, wherein the predetermined direction is a first predetermined direction, the first maintenance tray is a first waste liquid tray;

the second maintenance tray is a second waste liquid tray;

the maintenance tray moving mechanism is a waste liquid tray moving mechanism;

the first maintenance position is a first liquid receiving position;

the first non-maintenance position is a first standby position;

the second maintenance position is a second liquid receiving position;

the second non-maintenance position is a second standby position;

the maintenance tray movement control portion is a waste liquid tray movement control portion.

12. The liquid ejection device according to claim 11, wherein the maintenance unit further includes a first wiping member that is extended in the main scanning direction and is fixed at the first waste liquid tray to wipe liquid adhered to the liquid ejection surfaces of at least the first liquid ejection area.

13. The liquid ejection device according to claim 12, wherein the first wiping member further wipes the liquid ejection surfaces of the second liquid ejection area.

14. The liquid ejection device according to claim 12, wherein the maintenance unit further includes a second wiping member that is extended in the main scanning direction and is fixed at the first waste liquid tray to wipe liquid adhered to the liquid ejection surfaces of at least the second liquid ejection area.

15. The liquid ejection device according to claim 14, wherein the first wiping member is disposed at an end portion of the first waste liquid tray on a side thereof opposite to a side closest to the first standby position, wherein the second wiping member is disposed at another end portion of the first waste liquid tray on the side thereof closer to the first standby position.

16. The liquid ejection device according to claim 11, wherein the maintenance unit further includes:

a first cap tray having a plurality of first caps configured to make contact with the plurality of corresponding liquid ejection surfaces in the first liquid ejection area to enclose the corresponding liquid ejection surfaces;

a second cap tray having a plurality of second caps configured to be made contact with the plurality of corresponding liquid ejection surfaces in the second liquid ejection area to enclose the corresponding liquid ejection surfaces;

a cap tray moving mechanism configured to move the first cap tray and the second cap tray in a second predetermined direction, the cap tray moving mechanism configured to move the first cap tray between a first capping position where the first cap tray faces the first liquid ejection area and a first cap retracted position which is away from the first capping position in the second predetermined direction, and the cap tray moving mechanism configured to move the second cap tray between a second capping position where the second cap tray faces the second liquid ejection area and a second cap retracted position which is away from the second capping position in the second predetermined direction; and a cap tray movement control portion configured to control the cap tray moving mechanism to move the first cap tray and the second cap tray, wherein the first cap tray located at the first cap retracted position and the second cap tray located at the second cap retracted position at least partially overlap each other when viewed from a direction perpendicular to a main scanning direction and the sub scanning direction.

17. The liquid ejection device according to claim 16, wherein the first waste liquid tray located at the first standby position, the second waste liquid tray located at the second standby position, the first cap tray located at the first cap retracted position, and the second cap tray located at the second cap retracted position overlap each other when viewed from the direction perpendicular to the main scanning direction and the sub scanning direction.

18. The liquid ejection device according to claim 1, wherein the first maintenance tray is a first cap tray;

the second maintenance tray is a second cap tray;

the maintenance tray moving mechanism is a cap tray moving mechanism;

the first maintenance position is a first capping position;

the first non-maintenance position is a first cap retracted position;

the second maintenance position is a second capping position;

the second non-maintenance position is a second cap retracted position;

the maintenance tray movement control portion is a cap tray movement control portion.

19. The liquid ejection device according to claim 18, wherein a distance between the first capping position and the first cap retracted position is longer than a distance between the second capping position and the second cap retracted position.

20. The liquid ejection device according to claim 18, wherein a liquid ejection head movement control portion is configured to control a liquid ejection head moving mechanism to allow the liquid ejection heads to move to a contact position where the plurality of first and second caps located at the capping position make contact with the corresponding liquid ejection surfaces of the liquid ejection heads.

21. The liquid ejection device according to claim 18, wherein the cap tray moving mechanism includes:

a pair of first cap guide rails configured to guide the first cap tray;

a pair of second cap guide rails configured to guide the second cap tray;

a first cap tray support member slidably supported by the pair of first cap guide rails, the first cap tray support member configured to support the first cap tray to be movable in a direction perpendicular of the main scanning direction and the sub scanning direction;

a second cap tray support member slidably supported by the pair of second cap guide rails, the second cap tray support member configured to support the second cap tray to be movable in a direction perpendicular of the main scanning direction and the sub scanning direction;

a first elastic member interposed between the first cap tray support member and the first cap tray; and a second elastic member interposed between the second cap tray support member and the second cap tray.

22. The liquid ejection device according to claim 21, wherein the first elastic member is disposed at a position facing the pair of first cap guide rails, and the second elastic member is disposed at a position facing the pair of second cap guide rails.

23. The liquid ejection device according to claim 21, wherein the first elastic member includes a first spring and the second elastic member includes a second spring, and wherein the first spring has a spring constant that is smaller than that of the second spring and has a free length that is longer than that of the second spring.

24. The liquid ejection device according to claim 23, wherein a contact force per cap between each of the plurality of first caps and each of the corresponding liquid ejection surfaces in the first liquid ejection area is substantially the same as a contact force per cap between each of the plurality of second caps and the each of the corresponding liquid ejection surfaces in the second liquid ejection area.

25. The liquid ejection device according to claim 1, wherein at least a portion of the first maintenance tray and at least a portion of the second maintenance tray are configured to be engaged with each other.

26. A liquid ejection device comprising: a plurality of liquid ejection heads each having a liquid ejection surface that is elongated in a main scanning direction and is formed with a plurality of liquid ejection ports, wherein the plurality of liquid ejection surfaces define a first liquid ejection area and a second liquid ejection area;

a recording medium conveyor mechanism configured to convey a recording medium in a sub scanning direction to pass the recording medium through an area facing the plurality of liquid ejection surfaces;

a maintenance unit, including:

a first maintenance tray;

a second maintenance tray; and a maintenance tray moving mechanism configured to move the first maintenance tray and the second maintenance tray in a predetermined direction, the maintenance tray moving mechanism configured to move the first maintenance tray between a first maintenance position where the first maintenance tray faces the first liquid ejection area and a first non-maintenance position which is away from the first maintenance position in the predetermined direction, the maintenance tray moving mechanism configured to move the second maintenance tray between a second maintenance position where the second maintenance tray faces the second liquid ejection area and a second non-maintenance position which is away from the second maintenance position in the predetermined direction; and a maintenance tray movement control portion configured to control the maintenance tray movement mechanism to move the first maintenance tray and the second maintenance tray, wherein the first maintenance tray located at the first non-maintenance position and the second maintenance tray located at the second non-maintenance position at least partially overlap each other when viewed from a direction perpendicular to both the main scanning direction and the sub scanning direction, wherein the maintenance unit expands in the predetermined direction, so that the maintenance unit is longer in the predetermined direction when the first and second trays are positioned at their respective first and second maintenance positions than when the first and second trays are positioned at their respective first and second non-maintenance positions.

* * * * *